US010255860B2

(12) United States Patent
Na et al.

(10) Patent No.: US 10,255,860 B2
(45) Date of Patent: Apr. 9, 2019

(54) ORGANIC LIGHT EMITTING DIODE DISPLAY

(71) Applicant: LG Display Co., Ltd., Seoul (KR)

(72) Inventors: Sehwan Na, Gyeonggi-do (KR); Daegyu Jo, Seoul (KR); Sohyun Kim, Gyeonggi-do (KR); Kyoungjune Jung, Gyeonggi-do (KR); Jinwoo Park, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 4 days.

(21) Appl. No.: 15/438,959

(22) Filed: Feb. 22, 2017

(65) Prior Publication Data

US 2018/0137808 A1 May 17, 2018

(30) Foreign Application Priority Data

Nov. 11, 2016 (KR) ..... 10-2016-0150537

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0814* (2013.01); *G09G 2300/0819* (2013.01); *G09G 2300/0842* (2013.01); *G09G 2300/0861* (2013.01); *G09G 2310/0267* (2013.01); *G09G 2310/0286* (2013.01); *G09G 2310/08* (2013.01); *G09G 2320/0247* (2013.01)

(58) Field of Classification Search
CPC .... H03K 3/01; H03K 3/356104; H05B 37/02; G09G 3/3648
See application file for complete search history.

(56) References Cited

U.S. PATENT DOCUMENTS

2009/0160367 A1* 6/2009 Imanaka ..... H02M 3/07 315/307
2014/0098016 A1* 4/2014 Furuta ..... G09G 3/3648 345/100

* cited by examiner

*Primary Examiner* — Michael A Faragalla
(74) *Attorney, Agent, or Firm* — Morgan, Lewis & Bockius LLP

(57) ABSTRACT

An organic light emitting diode display is provided. The organic light emitting diode display includes a display panel having a plurality of pixels each including a light emitting diode, a data driver supplying a plurality of data signals to the plurality of pixels, a gate driver including a gate unit supplying a plurality of gate signals to the plurality of pixels and an emission unit supplying a plurality of emission signals to the plurality of pixels using a charge pump element to control a length of an emission period of the light emitting diode, and a timing controller supplying image data and a data control signal to the data driver and supplying a gate control signal to the gate driver.

13 Claims, 20 Drawing Sheets

ORGANIC LIGHT EMITTING DIODE DISPLAY

This application claims the benefit of Korean Patent Application No. 10-2016-0150537, filed in Korea on Nov. 11, 2016, the entire contents of which is incorporated herein by reference for all purposes as if fully set forth herein.

BACKGROUND

Field of the Invention

The present disclosure relates to a display device, and more particularly, to an organic light emitting diode (OLED) display.

Discussion of the Related Art

With the development of information society, demands for display devices displaying an image are increasing in various ways. Various flat panel displays, such as a liquid crystal display (LCD), a plasma display panel (PDP), and an organic light emitting diode (OLED) display, have been recently used.

An OLED display includes self-emitting elements capable of emitting light by themselves and has advantages of a fast response time, a high emission efficiency, a high luminance, and a wide viewing angle. The OLED display generally uses a current driving method that controls an amount of current and controls a luminance of an organic light emitting diode.

However, because the OLED display displays an image by allowing the organic light emitting diode to continuously emit light during each frame period, a driving thin film transistor (TFT) has to continuously maintain a turn-on state. Hence, the driving TFT is deteriorated.

Namely, a data signal of the same polarity is applied to a gate electrode of the driving TFT for a long period of time so that the driving TFT maintains the turn-on state. Hence, an interface characteristic between the gate electrode and a gate insulating layer of the driving TFT is deteriorated. As a result, a threshold voltage of the driving TFT and characteristics of a display panel are changed, and display quality of the OLED display is reduced.

In order to prevent a reduction in the display quality of the OLED display, a driving method was proposed to sense a change in the threshold voltage of the driving TFT and a change in the characteristics of the display panel and compensate for the changes. Such a compensation driving method divides one frame into a compensation period and a display period so as to sense a change in characteristics of each pixel of a display panel, senses a change in the characteristics of each pixel without operating a light emitting diode during the compensation period to modulate image data, and operates the light emitting diode based on the modulated image data during a remaining period (i.e., the display period) excluding the compensation period from the one frame to display an image.

A gate driver includes a gate unit outputting a scan signal and an emission unit outputting an emission signal, so that the light emitting diode does not emit light during the compensation period and emits light during the display period. The gate driver is described below with reference to FIGS. 1 and 2.

FIG. 1 illustrates a gate unit of a gate driver of a related art OLED display, and FIG. 2 illustrates an emission unit of a gate driver of a related art OLED display.

As shown in FIG. 1, a gate unit of a gate driver of a related art OLED display includes a shift register including a plurality of stages. An nth stage GD(n) of the shift register generates an nth gate signal GS(n) using a gate start voltage GVST, first, third, and fifth gate clocks GCLK1, GCLK3, and GCLK5, a gate high potential voltage GVDD, and a gate low potential voltage GVSS.

More specifically, the nth stage GD(n) of the shift register includes first to eighth transistors T1 to T8 and a first capacitor C1.

A gate of the first transistor T1 is connected to a terminal supplied with the gate start voltage GVST, a drain of the first transistor T1 is connected to a terminal supplied with the gate high potential voltage GVDD, and a source of the first transistor T1 is connected to a drain of the second transistor T2.

A gate of the second transistor T2 is connected to a terminal supplied with the fifth gate clock GCLK5, the drain of the second transistor T2 is connected to the source of the first transistor T1, and a source of the second transistor T2 is connected to a drain of the third transistor T3.

A gate of the third transistor T3 is connected to a gate QB node GQB, the drain of the third transistor T3 is connected to the source of the second transistor T2, and a source of the third transistor T3 is connected to the gate low potential voltage GVSS.

A gate of the fourth transistor T4 is connected to a terminal supplied with the third gate clock GCLK3, a drain of the fourth transistor T4 is connected to a terminal supplied with the gate high potential voltage GVDD, and a source of the fourth transistor T4 is connected to the gate QB node GQB.

A gate of the fifth transistor T5 is connected to a terminal supplied with the gate start voltage GVST, a drain of the fifth transistor T5 is connected to the gate QB node GQB, and a source of the fifth transistor T5 is connected to a terminal supplied with the gate low potential voltage GVSS.

A gate of the sixth transistor T6 is connected to a gate Q node GQ, a drain of the sixth transistor T6 is connected to a terminal supplied with the first gate clock GCLK1, and a source of the sixth transistor T6 is connected to a drain of the seventh transistor T7.

A gate of the seventh transistor T7 is connected to the gate QB node GQB, the drain of the seventh transistor T7 is connected to the source of the sixth transistor T6, and a source of the seventh transistor T7 is connected to a terminal supplied with the gate low potential voltage GVSS.

The nth gate signal GS(n) is output from a node between the sixth and seventh transistors T6 and T7. The first capacitor C1 is connected between the node between the sixth and seventh transistors T6 and T7 and the gate Q node GQ.

A gate of the eighth transistor T8 is connected to the gate Q node GQ, a drain of the eighth transistor T8 is connected to the gate QB node GQB, and a source of the eighth transistor T8 is connected to a terminal supplied with the gate low potential voltage GVSS.

As shown in FIG. 2, an emission unit of the gate driver of the related art OLED display includes an inverter including a plurality of stages. An nth stage ED(n) of the inverter generates an nth emission signal ES(n) using the nth gate signal GS(n) generated in the gate unit, first, second, third, and fifth emission clocks ECLK1, ECLK2, ECLK3, and ECLK5, an emission reset voltage ERST, an emission high potential voltage EVDD, and an emission low potential voltage EVSS.

More specifically, the nth stage ED(n) of the inverter includes ninth to eighteenth transistors T9 to T18 and a second capacitor C2.

A gate of the ninth transistor T9 is connected to a terminal supplied with the first emission clock ECLK1, a drain of the ninth transistor T9 is connected to a terminal supplied with the emission high potential voltage EVDD, and a source of the ninth transistor T9 is connected to an emission Q node EQ.

A gate of the tenth transistor T10 is connected to an emission QB node EQB, a drain of the tenth transistor T10 is connected to the emission Q node EQ, and a source of the tenth transistor T10 is connected to a terminal supplied with the emission low potential voltage EVSS.

A gate of the eleventh transistor T11 is connected to a terminal supplied with the third emission clock ECLK3, a drain of the eleventh transistor T11 is connected to a terminal supplied with a (n−1)th gate signal GS(n−1), and a source of the eleventh transistor T11 is connected to the emission QB node EQB.

A gate of the twelfth transistor T12 is connected to the emission Q node EQ, a drain of the twelfth transistor T12 is connected to a terminal supplied with the emission high potential voltage EVDD, and a source of the twelfth transistor T12 is connected to a drain of the thirteenth transistor T13.

A gate of the thirteenth transistor T13 is connected to the emission QB node EQB, the drain of the thirteenth transistor T13 is connected to the source of the twelfth transistor T12, and a source of the thirteenth transistor T13 is connected to a drain of the fourteenth transistor T14.

The nth emission signal ES(n) is output from a node between the twelfth and thirteenth transistors T12 and T13. The second capacitor C2 is connected between the node between the twelfth and thirteenth transistors T12 and T13 and the emission Q node EQ.

A gate of the fourteenth transistor T14 is connected to the emission QB node EQB, the drain of the fourteenth transistor T14 is connected to the source of the thirteenth transistor T13, and a source of the fourteenth transistor T14 is connected to a terminal supplied with the emission low potential voltage EVSS.

A gate of the fifteenth transistor T15 is connected to a terminal supplied with the nth gate signal GS(n), a drain of the fifteenth transistor T15 is connected to a terminal supplied with the emission reset voltage ERST, and a source of the fifteenth transistor T15 is connected to the emission QB node EQB.

A gate of the sixteenth transistor T16 is connected to a terminal supplied with the fifth emission clock ECLK5, a drain of the sixteenth transistor T16 is connected to the emission QB node EQB, and a source of the sixteenth transistor T16 is connected to a terminal supplied with the emission low potential voltage EVSS.

A gate of the seventeenth transistor T17 is connected to a node between the thirteenth and fourteenth transistors T13 and T14, a drain of the seventeenth transistor T17 is connected to a terminal supplied with the emission high potential voltage EVDD, and a source of the seventeenth transistor T17 is connected to a node between the fourteenth and fifteenth transistors T14 and T15.

A gate of the eighteenth transistor T18 is connected to a terminal supplied with the second emission clock ECLK2, a drain of the eighteenth transistor T18 is connected to the emission QB node EQB, and a source of the eighteenth transistor T18 is connected to a terminal supplied with the emission low potential voltage EVSS.

The related art OLED display senses a change in characteristics of each pixel while maintaining a light emitting diode of each pixel in an off-state in response to the emission signal generated in the emission unit of the gate driver during a compensation period of one frame, modulates image data, and maintains the light emitting diode of each pixel in an on-state in response to the emission signal generated in the emission unit of the gate driver during a remaining display period excluding the compensation period from the one frame, thereby displaying an image.

However, as a resolution of display devices recently increases, the total number of pixels increases and a driving current for a peak luminance emitted by one pixel decreases. Therefore, one pixel has to control the driving current at a lower level in order to represent a low gray level. However, there is a limit to a reduction in a voltage supplied by a driver.

Further, characteristic deviation of a plurality of thin film transistors of the display device further increases at the driving current of the lower level for the representation of the low gray level, causing a reduction in display quality, for example, a smear of the display device.

In order to prevent the reduction in the display quality of the display device, a driving method has been proposed to uniformly maintain an entire luminance of the display device by allowing a light emitting diode to emit light at a driving current of a higher level instead of emitting light only in a portion of one frame.

Further, as the resolution of the display device increases, an area allocated to one pixel decreases and the size of a storage capacitor of each pixel decreases. Hence, the reduction in the display quality, for example, a flicker of the display device may occur. Even in this instance, the reduction in the display quality can be prevented or reduced by applying a driving method that increases the driving current instead of reducing a length of an emission period in a display period of one frame.

Response characteristic is a most important factor in display devices of some special fields, such as virtual reality, that are recently introduced. Therefore, a driving method, such as duty driving or rolling shutter, that performs an emission operation only in a portion of one frame, is required in order to optimize the response characteristic.

However, the driver proposed so far, that can freely control a length of an emission period in a display period of one frame, has problems of an increase in power consumption, an increase in a bezel area, and a distortion of signals.

SUMMARY

Accordingly, the present disclosure is directed to an organ light emitting diode display that substantially obviates on ore more of the problems due to limitations and disadvantages of the related art.

Additional features and advantages of the invention will be set forth in the description which follows, and in part will be apparent from the description, or may be learned by practice of the invention. The objectives and other advantages of the invention may be realized and attained by the structure particularly pointed out in the written description and claims hereof as well as the appended drawings.

To achieve these and other advantages and in accordance with the purpose of the present invention, as embodied and broadly described, an organic light emitting diode display comprises a display panel including a plurality of pixels each including a light emitting diode, a data driver configured to supply a plurality of data signals to the plurality of pixels, a gate driver including a gate unit configured to supply a plurality of gate signals to the plurality of pixels and an emission unit configured to supply a plurality of emission signals to the plurality of pixels using a charge pump element and control a length of an emission period of the light emitting diode, and a timing controller configured to supply image data and a data control signal to the data driver and supply a gate control signal to the gate driver.

The emission unit may include a plurality of stages that is cascade-connected to one another. Each stage may include a Q node determining so that the plurality of emission signals is output at a high level, a QB node determining so that the plurality of emission signals is output at a low level, a Q' node determining so that the QB node has the high level, and the charge pump element connected to the Q' node.

An emission clock may be supplied to the charge pump element. The Q' node may be changed from a floating state to the high level by the emission clock and the charge pump element.

The charge pump element may be a charge pump capacitor or a charge pump thin film transistor.

The emission unit may generate the plurality of emission signals using an emission start voltage, an emission reset voltage, a plurality of emission clocks, and the plurality of gate signals. The plurality of emission clocks may include first to fifth emission clocks, and the plurality of gate signals may include nth and (n−1)th gate signals. The plurality of emission signals may include nth and (n−1)th emission signals, and the plurality of stages may include an nth stage. The nth stage may include ninth to twentieth transistors, a second capacitor, and the charge pump element.

A gate, a drain, and a source of the ninth transistor may be connected to the first emission clock, an emission high potential voltage, and a drain of the tenth transistor, respectively. A gate, the drain, and a source of the tenth transistor may be connected to the (n−1)th emission signal or the emission start voltage, the source of the ninth transistor, and the Q node, respectively. A gate, a drain, and a source of the eleventh transistor may be connected to the QB node, the Q node, and an emission low potential voltage, respectively. A gate, a drain, and a source of the twelfth transistor may be connected to the (n−1)th gate signal, the emission high potential voltage, and the QB node, respectively. A gate, a drain, and a source of the thirteenth transistor may be connected to the Q node, the emission high potential voltage, and a drain of the fourteenth transistor, respectively. A gate, the drain, and a source of the fourteenth transistor may be connected to the QB node, the source of the thirteenth transistor, and a drain of the fifteenth transistor, respectively. A gate, the drain, and a source of the fifteenth transistor may be connected to the QB node, the source of the fourteenth transistor, and the emission low potential voltage, respectively. A gate, a drain, and a source of the sixteenth transistor may be connected to the nth gate signal, the emission reset voltage, and the QB node, respectively. A gate, a drain, and a source of the seventeenth transistor may be connected to a node between the thirteenth and fourteenth transistors, the emission high potential voltage, and a node between the fourteenth and fifteenth transistors, respectively. A gate, a drain, and a source of the eighteenth transistor may be connected to the second emission clock, the QB node, and the emission low potential voltage, respectively. A gate, a drain, and a source of the nineteenth transistor may be connected to the Q' node, the emission high potential voltage, and the QB node, respectively. A gate, a drain, and a source of the twentieth transistor may be connected to the (n−1)th emission signal or the emission start voltage, the Q' node, and the emission low potential voltage, respectively. The second capacitor may be connected between the node between the thirteenth and fourteenth transistors and the Q node. The charge pump element may be connected between the first emission clock and the Q' node. The nth emission signal may be output from the node between the thirteenth and fourteenth transistors.

The emission unit may generate the plurality of emission signals using an emission start voltage and a plurality of emission clocks. The plurality of emission clocks may include first and second emission clocks. The plurality of emission signals may include nth and (n−1)th emission signals, and the plurality of stages may include an nth stage. The nth stage may include ninth to eleventh transistors, thirteenth to fifteenth transistors, seventeenth to twentieth transistors, a second capacitor, and the charge pump element.

A gate, a drain, and a source of the ninth transistor may be connected to the first emission clock, an emission high potential voltage, and a drain of the tenth transistor, respectively. A gate, the drain, and a source of the tenth transistor may be connected to the (n−1)th emission signal or the emission start voltage, the source of the ninth transistor, and the Q node, respectively. A gate, a drain, and a source of the eleventh transistor may be connected to the QB node, the Q node, and an emission low potential voltage, respectively. A gate, a drain, and a source of the thirteenth transistor may be connected to the Q node, the emission high potential voltage, and a drain of the fourteenth transistor, respectively. A gate, the drain, and a source of the fourteenth transistor may be connected to the QB node, the source of the thirteenth transistor, and a drain of the fifteenth transistor, respectively. A gate, the drain, and a source of the fifteenth transistor may be connected to the QB node, the source of the fourteenth transistor, and the emission low potential voltage, respectively. A gate, a drain, and a source of the seventeenth transistor may be connected to a node between the thirteenth and fourteenth transistors, the emission high potential voltage, and a node between the fourteenth and fifteenth transistors, respectively. A gate, a drain, and a source of the eighteenth transistor may be connected to the second emission clock, the QB node, and the emission low potential voltage, respectively. A gate, a drain, and a source of the nineteenth transistor may be connected to the Q' node, the emission high potential voltage, and the QB node, respectively. A gate, a drain, and a source of the twentieth transistor may be connected to the (n−1)th emission signal or the emission start voltage, the Q' node, and the emission low potential voltage, respectively. The second capacitor may be connected between the node between the thirteenth and fourteenth transistors and the Q node. The charge pump element may be connected between the first emission clock and the Q' node. The nth emission signal may be output from the node between the thirteenth and fourteenth transistors.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

In embodiments of the invention, switching elements of a gate driving circuit may be implemented as n-type or p-type metal oxide semiconductor field effect transistors (MOSFETs). Each transistor is a three-electrode element including a gate, a source, and a drain. The source is an electrode for supplying carriers to the transistor. The carriers inside the transistor begin to flow from the source. The drain is an electrode from which the carriers exit the transistor. Namely, carriers in the MOSFET flow from the source to the drain. In the case of an n-type MOSFET (NMOS), because carriers are electrons, a source voltage is less than a drain voltage so that electrons can flow from a source to a drain. In the n-type MOSFET, because electrons flow from the source to the drain, a current flows from the drain to the source. In the case of a p-type MOSFET (PMOS), because carriers are holes, a source voltage is greater than a drain voltage so that holes can flow from a source to a drain. In the p-type MOSFET, because holes flow from the source to the drain, a current flows from the source to the drain. It should be noted that the source and the drain of the MOSFET are not fixed. For example, the source and the drain of the MOSFET may be changed depending on an applied voltage. Thus, the source and the drain of the transistor may be referred to as a first electrode (or a second electrode) and a second electrode (or a first electrode), respectively. In other words, embodiments of the invention are not limited due to the source and the drain of the transistor.

In embodiments of the invention, a gate-on voltage refers to an operating voltage capable of turning on a transistor. Therefore, a gate-on voltage in an n-type MOSFET indicates a high level voltage, and a gate-on voltage in a p-type MOSFET indicates a low level voltage. Similarly, a gate-off voltage in the n-type MOSFET indicates a low level voltage, and a gate-off voltage in the p-type MOSFET indicates a high level voltage.

Figure 3:
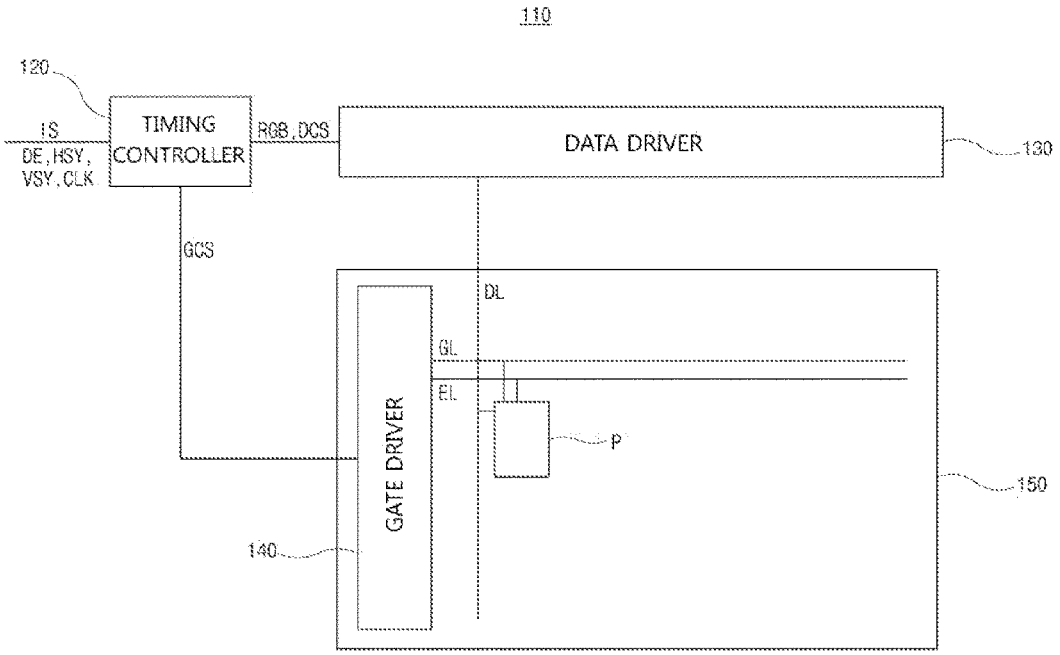
FIG. 3 illustrates an OLED display according to a first embodiment of the invention.

FIG. 3 illustrates an organic light emitting diode (OLED) display according to a first embodiment of the invention.

As shown in FIG. 3, an OLED display 110 according to a first embodiment of the invention includes a timing controller 120, a data driver 130, a gate driver 140, and a display panel 150.

The timing controller 120 generates a gate control signal GCS, a data control signal DCS, and image data RGB using an image signal IS and a plurality of timing signals including a data enable signal DE, a horizontal sync signal HSY, a vertical sync signal VSY, a clock CLK, etc. that are transmitted from an external system such as a graphic card and a TV system. The timing controller 120 supplies the data control signal DCS and the image data RGB to the data driver 130 and supplies the gate control signal GCS to the gate driver 140.

The data driver 130 generates a data signal using the data control signal DCS and the image data RGB received from the timing controller 120 and supplies the data signal to data lines DL of the display panel 150.

The gate driver 140 generates a gate signal and an emission signal using the gate control signal GCS received from the timing controller 120 and respectively supplies the gate signal and the emission signal to gate lines GL and emission lines EL of the display panel 150. The gate driver 140 may be a gate-in panel (GIP) circuit formed on a substrate of the display panel 150 on which the data lines DL, the gate lines GL, the emission lines EL, and pixels P are formed.

The display panel 150 displays an image using the gate signal and the data signal.

More specifically, the display panel 150 includes the data lines DL and the gate lines GL that intersect each other to define pixel areas, the pixels P connected to the data lines DL and the gate lines GL, and the emission lines EL connected to the pixels P.

The OLED display 110 displays the image while compensating for changes in characteristics of each pixel P using the gate signal, the data signal, and the emission signal, and at the same time controlling a length of an emission period. This is described in detail below.

Figure 4:
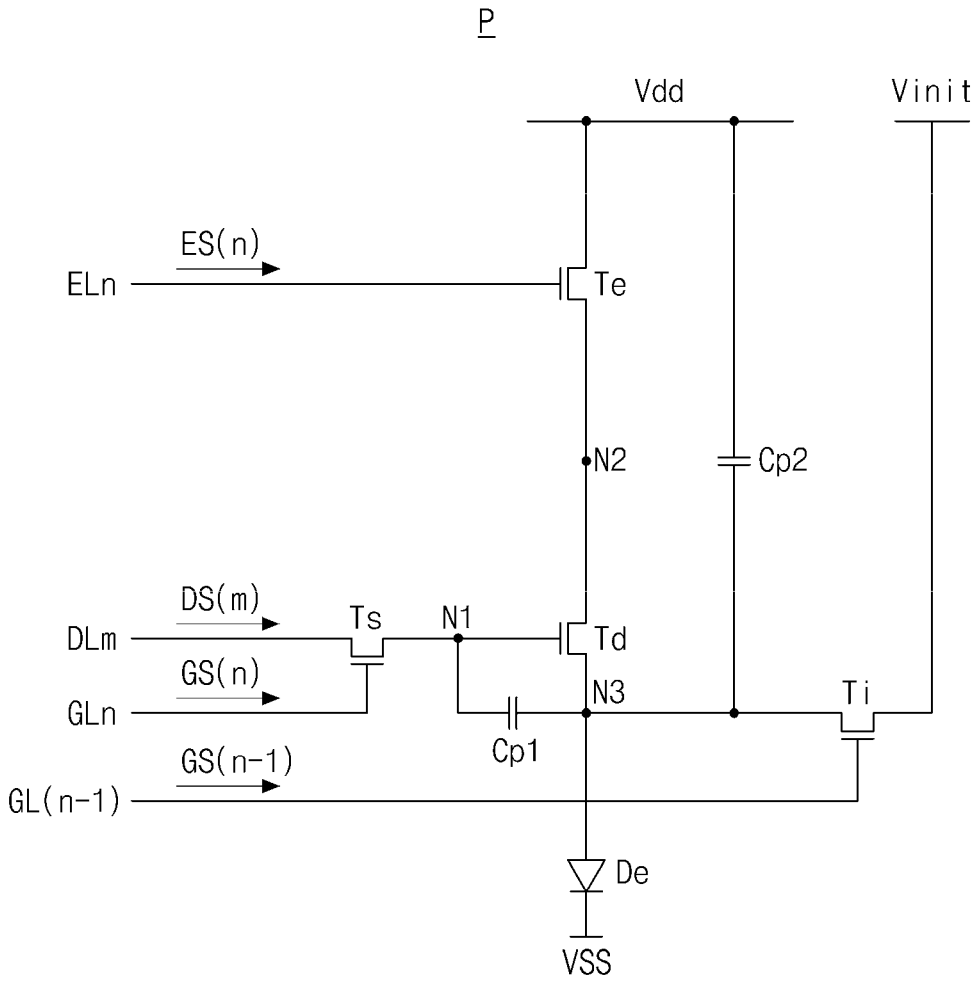
FIG. 4 illustrates a pixel of an OLED display according to a first embodiment of the invention.

FIG. 4 illustrates a pixel of the OLED display according to the first embodiment of the invention. More specifically, FIG. 4 illustrates a pixel P having 4T2C structure including four transistors and two capacitors, by way of example.

As shown in FIG. 4, a pixel P of the OLED display 110 according to the first embodiment of the invention includes a switching transistor Ts, an emission transistor Te, a driving transistor Td, an initial transistor T1, a light emitting diode De, and first and second pixel capacitors Cp1 and Cp2.

FIG. 4 illustrates the switching transistor Ts, the emission transistor Te, the driving transistor Td, and the initial transistor T1 are n-type transistors, by way of example. However, embodiments of the invention are not limited thereto. In another embodiment, the switching transistor Ts, the emission transistor Te, the driving transistor Td, and the initial transistor T1 may be p-type transistors.

The switching transistor Ts transfers an mth data signal DS(m) of an mth data line DLm to the driving transistor Td in response to an nth gate signal GS(n). A gate, a drain, and a source of the switching transistor Ts are connected to an nth gate line GLn, the mth data line DLm, and a first node N1, respectively.

The emission transistor Te transfers a high potential voltage Vdd to a second node n2 in response to an nth emission signal ES(n). A gate, a drain, and a source of the emission transistor Te are connected to an nth emission line ELn, an input terminal of the high potential voltage Vdd, and a second node N2, respectively.

The driving transistor Td transfers a voltage of the second node N2 to a third node N3 in accordance with a voltage of the first node N1. A gate, a drain, and a source of the driving transistor Td are connected to the first node N1, the second node N2, and the third node N3, respectively.

The initial transistor T1 transfers an initial voltage Vinit to the third node N3 in response to a (n−1)th gate signal GS(n−1). A gate, a drain, and a source of the initial transistor T1 are connected to a (n−1)th gate line GL(n−1), an input terminal of the initial voltage Vinit, and the third node N3, respectively.

The light emitting diode De emits light in accordance with a voltage of the third node N3. An anode and a cathode of the light emitting diode De are connected to the third node N3 and an input terminal of a low potential voltage Vss, respectively.

The first pixel capacitor Cp1 is connected between the first node N1 and the third node N3, and the second pixel capacitor Cp2 is connected between the input terminal of the high potential voltage Vdd and the third node N3.

The first pixel capacitor Cp1 stores a threshold voltage Vth of the driving transistor Td in response to the nth emission signal ES(n) and the (n−1)th gate signal GS(n−1) during a compensation period. The first pixel capacitor Cp1 uniformly holds a gate voltage of the driving transistor Td in response to the nth emission signal ES(n) and the nth gate signal GS(n) during one frame.

The second pixel capacitor Cp2 stabilizes the gate voltage of the driving transistor Td and increases efficiency of the mth data signal DS(m).

As described above, the OLED display 110 according to the first embodiment of the invention is configured such that the gate driver 140 generates the gate signal and the emission signal and supplies the gate signal and the emission signal to each pixel P, and each pixel P senses the threshold voltage Vth of the driving transistor Td in response to the gate signal and the emission signal during a compensation period of one frame to transfer the threshold voltage Vth to the timing controller 120. Hence, the OLED display 110 displays an image using image data that is modulated so that a change in the threshold voltage Vth is reflected by the timing controller 120 in response to the gate signal and the emission signal during a display period of one frame, thereby preventing a reduction in image quality.

The gate driver 140 of the OLED display 110 according to the first embodiment of the invention can control a length of an emission period in a display period of each pixel P by controlling lengths of a high level period and a low level period of the emission signal. This is described in detail below.

Figure 5:
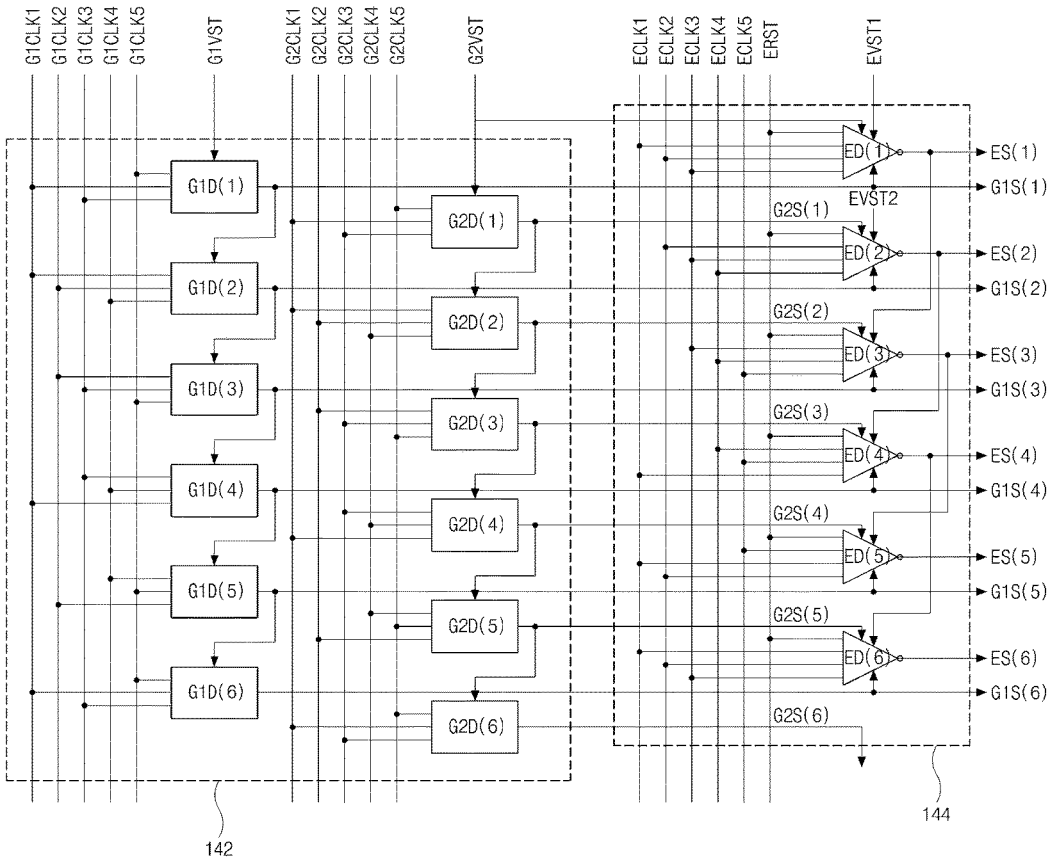
FIG. 5 illustrates a gate driver of an OLED display according to a first embodiment of the invention.
Figure 6:
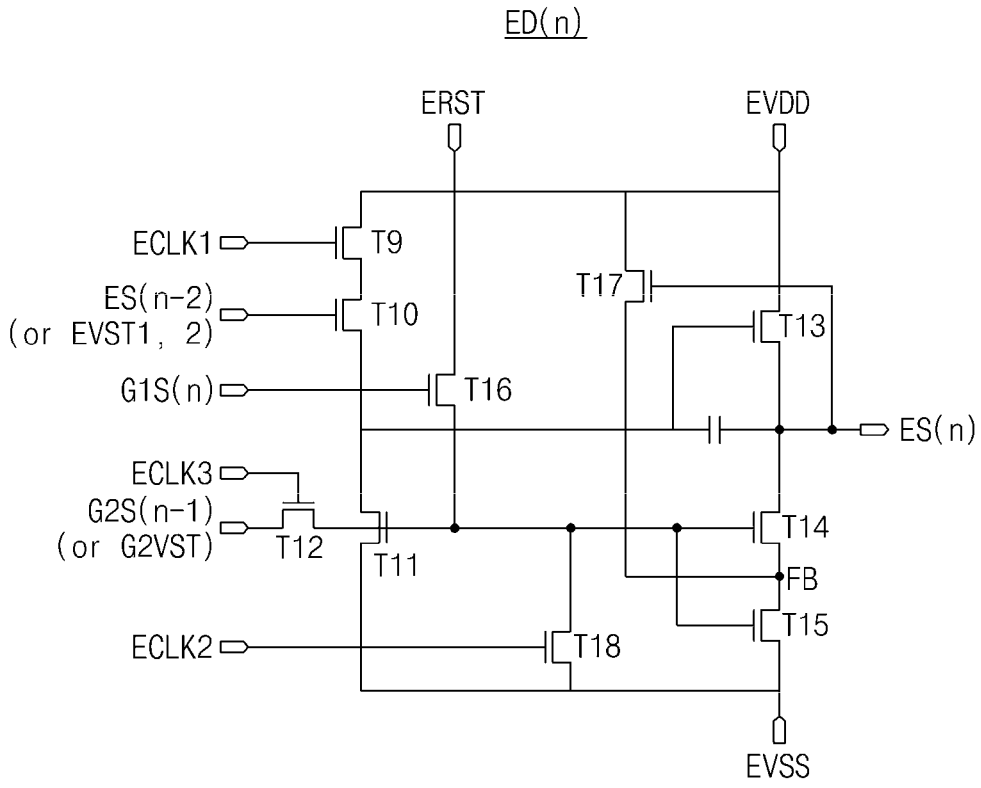
FIG. 6 illustrates a stage of an emission unit of a gate driver of an OLED display according to a first embodiment of the invention.
Figure 7:
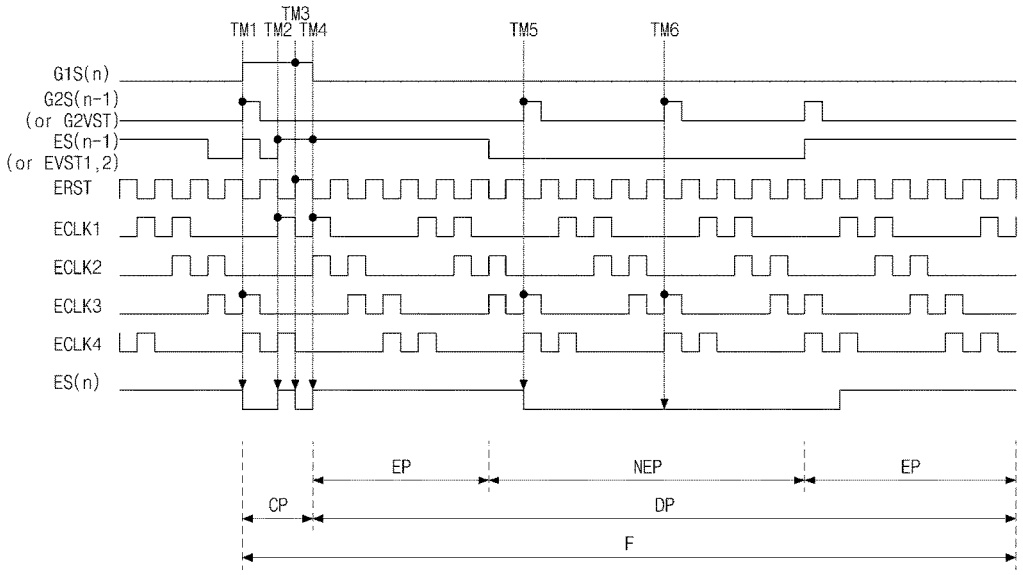
FIG. 7 is a timing diagram of signals related to a stage of an emission unit of a gate driver of an OLED display according to a first embodiment of the invention.

FIG. 5 illustrates a gate driver of the OLED display according to the first embodiment of the invention. FIG. 6 illustrates a stage of an emission unit of a gate driver of the OLED display according to the first embodiment of the invention. FIG. 7 is a timing diagram of signals related to a stage of an emission unit of a gate driver of the OLED display according to the first embodiment of the invention.

As shown in FIG. 5, the gate driver 140 of the OLED display 110 according to the first embodiment of the invention includes a gate unit 142 generating a plurality of gate1 signals G1S(n) and a plurality of gate2 signals G2S(n) and an emission unit 144 generating a plurality of emission signals ES(n) using a start voltage, a clock, a reset voltage, a high potential voltage, and a low potential voltage.

The gate unit 142 includes a first shift register that includes a plurality of stages GD1(*n*) and generates a plurality of gate1 signals G1S(n), and a second shift register that includes a plurality of stages GD2(*n*) and generates a plurality of gate2 signals G2S(n). The emission unit 144 includes an inverter that includes a plurality of stages ED(n) and generates a plurality of emission signals ES(n).

More specifically, the first shift register of the gate unit 142 generates the plurality of gate1 signals G1S(n) using a gate1 start voltage G1VST or an output G1S(n−1) of a previous stage, first to fifth gate1 clocks G1CLK1 to G1CLK5, a gate high potential voltage GVDD, and a gate low potential voltage GVSS. The second shift register of the gate unit 142 generates the plurality of gate1 signals G2S(n) using a gate2 start voltage G2VST or an output G2S(n−1) of a previous stage, first to fifth gate2 clocks G2CLK1 to G2CLK5, the gate high potential voltage GVDD, and the gate low potential voltage GVSS.

The inverter of the emission unit 144 generates the plurality of emission signals ES(n) using first and second emission start voltages EVST1 and EVST2 or outputs ES(n−1) and ES(n−2) of a previous stage, first to fifth emission clocks ECLK1 to ECLK5, an emission reset voltage ERST, an emission high potential voltage EVDD, and an emission low potential voltage EVSS.

For example, a first stage GD(1) of the first shift register of the gate unit 142 may generate a first gate1 signal G1S(1) using the gate1 start voltage G1VST, the first, third, and fifth gate1 clocks G1CLK1, G1CLK3, and G1CLK5, the gate high potential voltage GVDD, and the gate low potential voltage GVSS. A first stage GD(2) of the second shift register of the gate unit 142 may generate a first gate2 signal G2S(1) using the gate2 start voltage G2VST, the first, third, and fifth gate2 clocks G2CLK1, G2CLK3, and G2CLK5, the gate high potential voltage GVDD, and the gate low potential voltage GVSS. A first stage ED(1) of the inverter of the emission unit 144 may generate a first emission signal ES(1) using the first emission start voltage EVST1, the emission reset voltage ERST, the first, second, and third emission clocks ECLK1, ECLK2, and ECLK3, the emission high potential voltage EVDD, and the emission low potential voltage EVSS.

The plurality of stages GD1(*n*) of the first shift register of the gate unit 142, the plurality of stages GD2(*n*) of the second shift register of the gate unit 142, and the plurality of stages ED(n) of the inverter of the emission unit 144 may have a cascade connection relationship and may sequentially supply the plurality of gate1 signals G1S(n), the plurality of gate2 signals G2S(n), and the plurality of emission signals ES(n) to the pixels P of the display panel 150 through nodes of the stages GD1(*n*), GD2(*n*), and ED(n).

Figure 1:
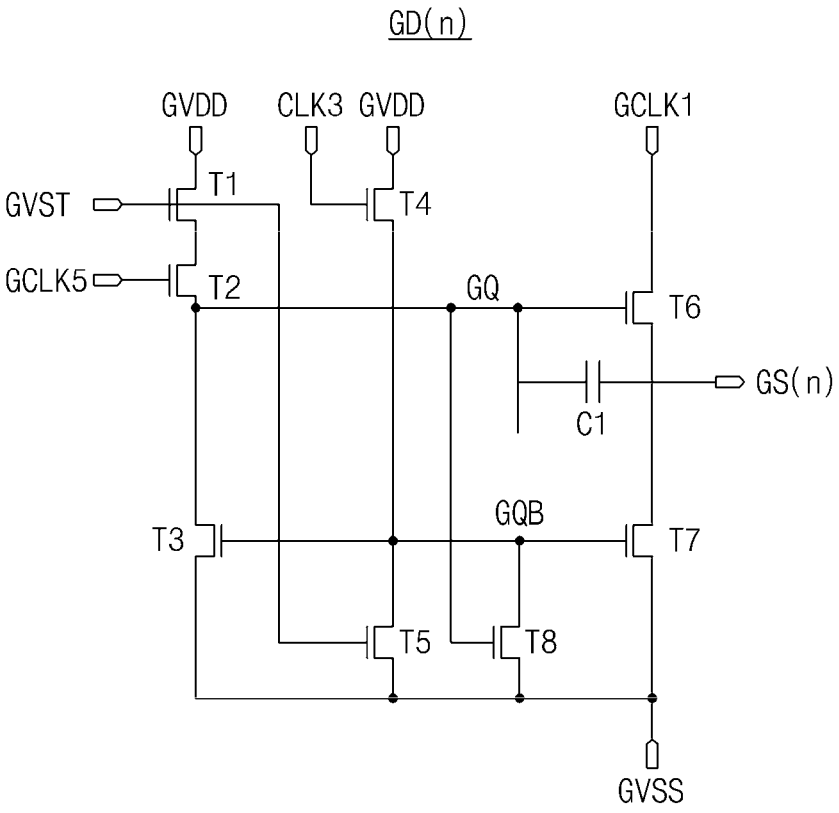
FIG. 1 (RELATED ART)
FIG. 1 illustrates a gate unit of a gate driver of a related art organic light emitting diode (OLED) display.
Figure 2:
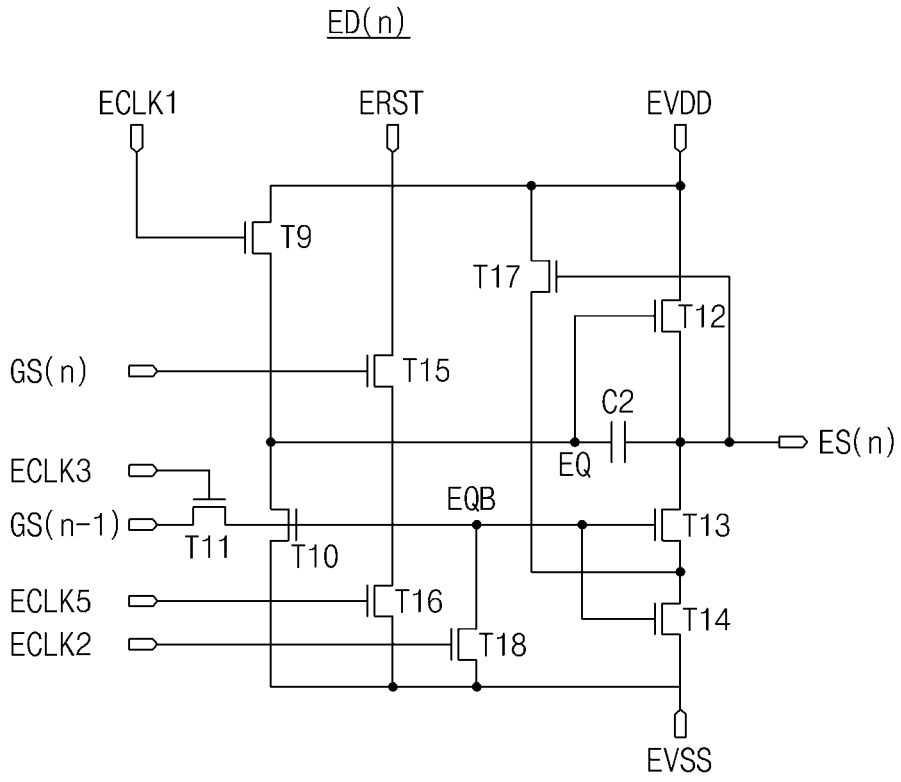
FIG. 2 (RELATED ART)
FIG. 2 illustrates an emission unit of a gate driver of a related art OLED display

Each of the stages GD1(*n*) and GD2(*n*) of the first and second shift registers of the gate unit 142 of the gate driver 140 may include first to eighth transistors and a first capacitor as shown in FIG. 1.

Further, as shown in FIG. 6, each of the plurality of stages ED(n) of the inverter of the emission unit 144 of the gate driver 140 may include ninth to sixteenth transistors T9 to T16 and a second capacitor C2.

A gate of the ninth transistor T9 is connected to a terminal supplied with the first emission clock ECLK1, a drain of the ninth transistor T9 is connected to a terminal supplied with the emission high potential voltage EVDD, and a source of the ninth transistor T9 is connected to a drain of the tenth transistor T10.

A gate of the tenth transistor T10 is connected to a terminal supplied with the (n−2)th emission signal ES(n−2) or the first and second emission start voltages EVST1 and EVST2, the drain of the tenth transistor T10 is connected to the source of the ninth transistor T9, and a source of the tenth transistor T10 is connected to an emission Q node EQ.

A gate of the eleventh transistor T11 is connected to an emission QB node EQB, a drain of the eleventh transistor T11 is connected to the emission Q node EQ, and a source of the eleventh transistor T11 is connected to a terminal supplied with the emission low potential voltage EVSS.

A gate of the twelfth transistor T12 is connected to a terminal supplied with the third emission clock ECLK3, a drain of the twelfth transistor T12 is connected to a terminal supplied with the (n−1)th gate2 signal G2S(n−1) or the gate2 start voltage G2VST, and a source of the twelfth transistor T12 is connected to the emission QB node EQB.

A gate of the thirteenth transistor T13 is connected to the emission Q node EQ, a drain of the thirteenth transistor T13 is connected to a terminal supplied with the emission high potential voltage EVDD, and a source of the thirteenth transistor T13 is connected to a drain of the fourteenth transistor T14.

A gate of the fourteenth transistor T14 is connected to the emission QB node EQB, the drain of the fourteenth transistor T14 is connected to the source of the thirteenth transistor T13, and a source of the fourteenth transistor T14 is connected to a drain of the fifteenth transistor T15.

The nth emission signal ES(n) is output from a node between the thirteenth and fourteenth transistors T13 and T14. The second capacitor C2 is connected between the node between the thirteenth and fourteenth transistors T13 and T14 and the emission Q node EQ.

A gate of the fifteenth transistor T15 is connected to the emission QB node EQB, the drain of the fifteenth transistor T15 is connected to the source of the fourteenth transistor T14, and a source of the fifteenth transistor T15 is connected to a terminal supplied with the emission low potential voltage EVSS.

A gate of the sixteenth transistor T16 is connected to a terminal supplied with an nth gate1 signal GS1(*n*), a drain of the sixteenth transistor T16 is connected to a terminal supplied with the emission reset voltage ERST, and a source of the sixteenth transistor T16 is connected to the emission QB node EQB.

A gate of the seventeenth transistor T17 is connected to the node between the thirteenth and fourteenth transistors T13 and T14, a drain of the seventeenth transistor T17 is connected to a terminal supplied with the emission high potential voltage EVDD, and a source of the seventeenth transistor T17 is connected to a node between the fourteenth and fifteenth transistors T14 and T15.

A gate of the eighteenth transistor T18 is connected to a terminal supplied with the second emission clock ECLK2, a drain of the eighteenth transistor T18 is connected to the emission QB node EQB, and a source of the eighteenth transistor T18 is connected to a terminal supplied with the emission low potential voltage EVSS.

The embodiment of the invention described that the plurality of transistors of the gate unit 142 and the emission unit 144 is n-type transistors, by way of example. However, the embodiment of the invention is not limited thereto. In another embodiment, the plurality of transistors of the gate unit 142 and the emission unit 144 may be p-type transistors.

As shown in FIG. 7 that illustrates operation timing of the emission unit 144, at a first timing TM1, when a (n−1)th gate2 signal G2S(n−1) (or the gate2 start voltage G2VST) and the third emission clock ECLK3 are generated at a high level, the emission QB node EQB is at a high level. Hence, the fourteenth and fifteenth transistors T14 and T15 are turned on. Further, the emission low potential voltage EVSS is output to an nth emission signal ES(n) of a low level, and an initial voltage Vinit is applied to the third node N3 of each pixel P.

At a second timing TM2, when a (n−2)th emission signal ES(n−2) (or the first and second emission start voltages EVST1 and EVST2) and the first emission clock ECLK1 are generated at a high level, the ninth and tenth transistors T9 and T10 are turned on. Hence, the emission Q node EQ is at a high level. Further, the thirteenth transistor T13 is turned on. Hence, the emission high potential voltage EVDD is output to the nth emission signal ES(n) of a high level, and a voltage is sensed at the third node N3 of each pixel P.

At a third timing TM3, when the emission reset voltage ERST is generated at a high level, the emission QB node EQB is at a high level. Hence, the fourteenth and fifteenth transistors T14 and T15 are turned on. Further, the emission low potential voltage EVSS is output to the nth emission signal ES(n) of a low level, and image data is modulated so that a change in characteristics of each pixel P is reflected.

At a fourth timing TM4, when the first emission clock ECLK1 is generated at a high level, the ninth and tenth transistors T9 and T10 are turned on. Hence, the emission Q node EQ is at a high level. Further, the thirteenth transistor T13 is turned on. Hence, the emission high potential voltage EVDD is output to the nth emission signal ES(n) of a high level, and the light emitting diode De of each pixel P is in an on-state and emits light.

At fifth and sixth timings TM5 and TM6 that are timings before the first emission clock ECLK1 is at a high level, when the (n−1)th gate2 signal G2S(n−1) (or the gate2 start voltage G2VST) and the third emission clock ECLK3 are generated at a high level, the emission QB node EQB is at a high level. Hence, the fourteenth and fifteenth transistors T14 and T15 are turned on. Further, the emission low potential voltage EVSS is output to the nth emission signal ES(n) of a low level, and the light emitting diode De of each pixel P is in an off on-state and does not emit light.

As described above, the OLED display 110 according to the first embodiment of the invention divides one frame F into a compensation period CP and a display period DP and drives the pixels P. Further, the OLED display 110 according to the first embodiment of the invention senses the threshold voltage of the driving transistor Td during the compensation period CP to modulate image data and displays an image using the modulated image data during the display period DP.

The OLED display 110 divides the display period DP into an emission period EP and a non-emission period NEP and supplies the gate2 start voltage G2VST having a plurality of pulses (of a high level) to the gate unit 142 during the non-emission period NEP so that the plurality of gate2 signals G2S(n) output from the gate unit 142 has a plurality of pulses (of a high level). Hence, the OLED display 110 can continuously apply a high level to the emission QB node EQB and can allow the emission signals ES(n) output from the emission unit 144 of the gate driver 140 to have a low level during the non-emission period NEP.

Namely, the embodiment of the invention can improve the display quality of the OLED display 110 by controlling a length of the emission period EP (or a length ratio of the emission period EP to the non-emission period NEP) in each pixel P and can easily apply the OLED display 110 to a high resolution display.

However, in the OLED display 110 according to the first embodiment of the invention, because the plurality of gate2 signals G2S(n) output from the gate driver 140 has a plurality of pulses, power consumption may increase depending on an increase in the number of switching operations between a high level and a low level of the gate2 signals G2S(n). Further, an output signal may be delayed.

Further, because the gate driver 140 includes the first and second shift registers, an area of the gate driver 140 may increase. Hence, a bezel area of the OLED display 110 may increase.

Another embodiment can prevent an increase in power consumption, an increase in an bezel area, and signal distortion by controlling a length of an emission period using a self-charging method using charge pumping instead of a toggling method using an output (i.e., a plurality of gate2 signals G2S(n)) of a second shift register. This is described below with reference to FIGS. 8 to 10.

Figure 8:
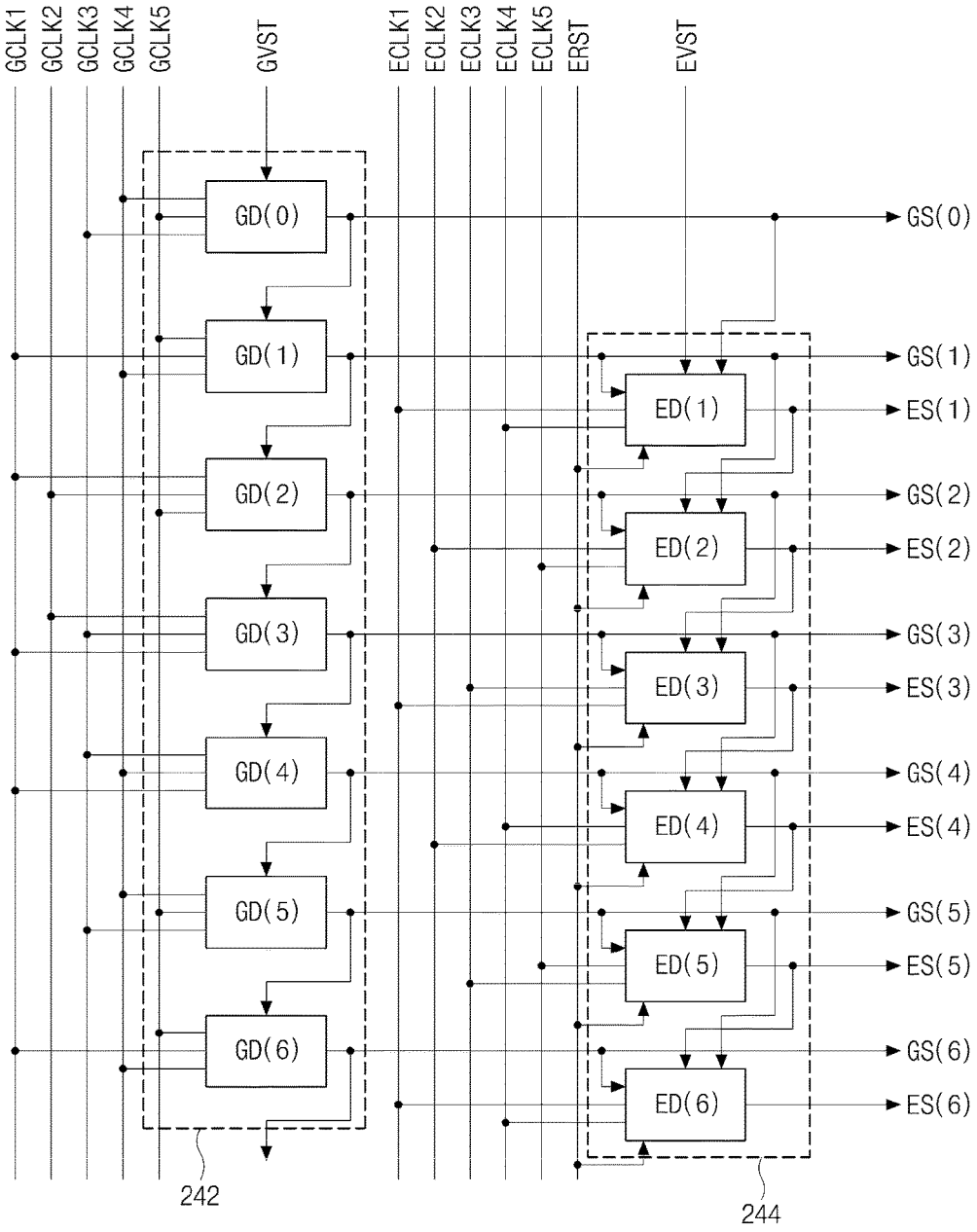
FIG. 8 illustrates a gate driver of an OLED display according to a second embodiment of the invention.
Figure 9:
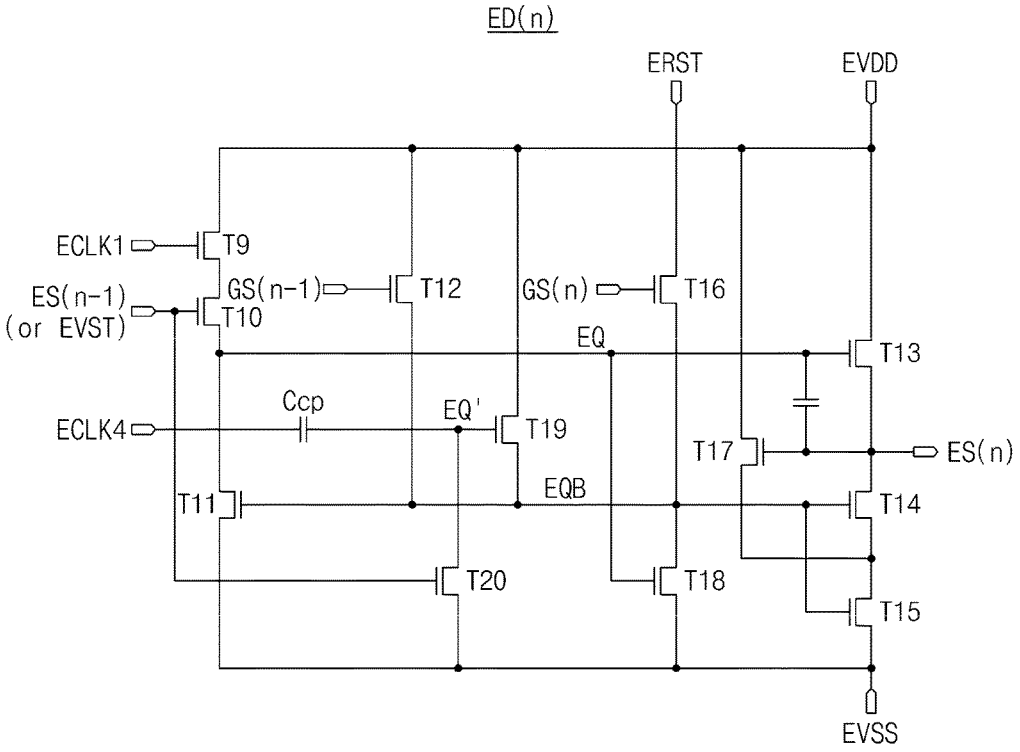
FIG. 9 illustrates a stage of an emission unit of a gate driver of an OLED display according to a second embodiment of the invention.
Figure 10:
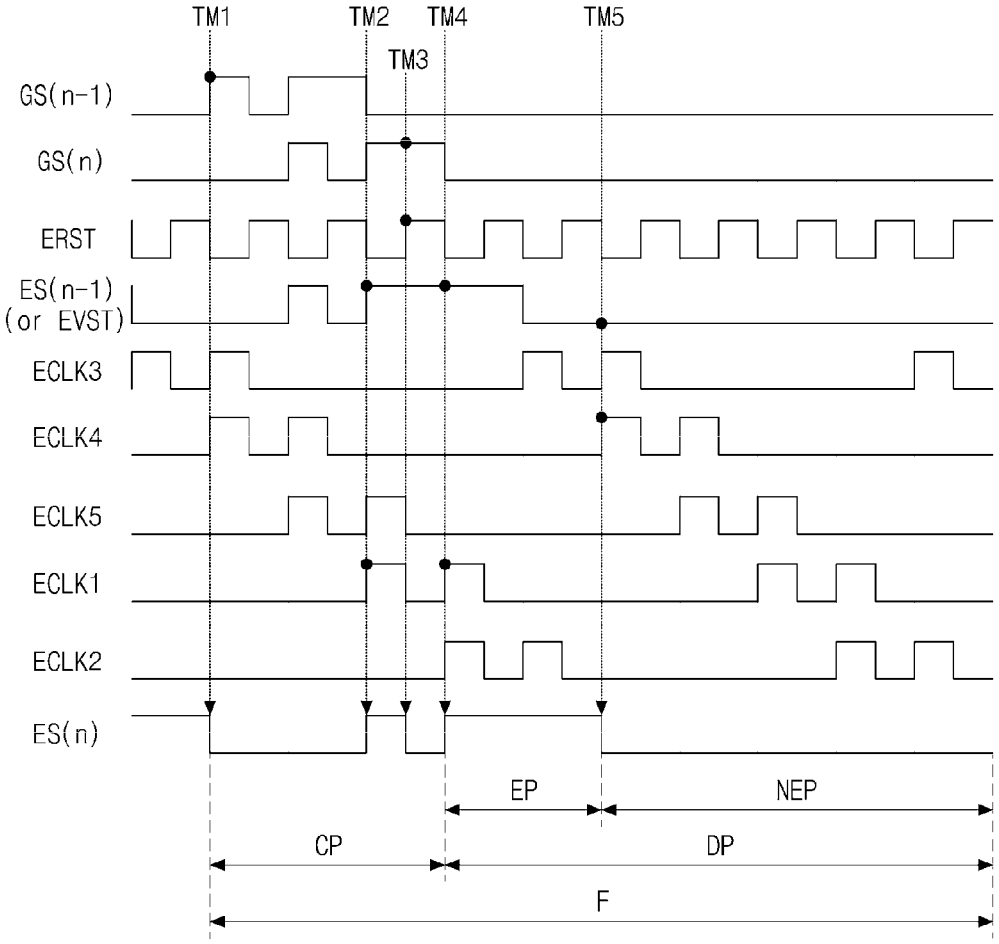
FIG. 10 is a timing diagram of signals related to a stage of an emission unit of a gate driver of an OLED display according to a second embodiment of the invention.

FIG. 8 illustrates a gate driver of an OLED display according to a second embodiment of the invention. FIG. 9 illustrates a stage of an emission unit of a gate driver of an OLED display according to a second embodiment of the invention. FIG. 10 is a timing diagram of signals related to a stage of an emission unit of a gate driver of an OLED display according to a second embodiment of the invention. Since entire configuration and pixel configuration of the OLED display according to the second embodiment of the invention are substantially the same as the OLED display according to the first embodiment of the invention, a further description may be briefly made or may be entirely omitted.

As shown in FIG. 8, a gate driver 240 of the OLED display according to the second embodiment of the invention includes a gate unit 242 generating a plurality of gate signals GS(n) and an emission unit 244 generating a plurality of emission signals ES(n) using a start voltage, a clock, a reset voltage, a high potential voltage, and a low potential voltage.

The gate unit 242 includes a shift register including a plurality of stages GD(n), and the emission unit 244 includes an inverter including a plurality of stages ED(n).

More specifically, the shift register of the gate unit 242 generates the plurality of gate signals GS(n) using a gate start voltage GVST or an output GS(n−1) of a previous stage, first to fifth gate clocks GCLK1 to GCLK5, a gate high potential voltage GVDD, and a gate low potential voltage GVSS. The inverter of the emission unit 244 generates the plurality of emission signals ES(n) using an emission start voltage EVST or an output ES(n−1) of a previous stage, first to fifth emission clocks ECLK1 to ECLK5, an emission reset voltage ERST, an emission high potential voltage EVDD, and an emission low potential voltage EVSS.

For example, a first stage GD(1) of the shift register of the gate unit 242 may generate a first gate signal GS(1) using a zeroth gate signal GS(0), the first, fourth, and fifth gate clocks GCLK1, GCLK4, GCLK5, the gate high potential voltage GVDD, and the gate low potential voltage GVSS. A first stage ED(1) of the inverter of the emission unit 244 may generate a first emission signal ES(1) using the emission start voltage EVST, the zeroth gate signal GS(0), the emission reset voltage ERST, the first and fourth emission clocks ECLK1 and ECLK4, the emission high potential voltage EVDD, and the emission low potential voltage EVSS.

The plurality of stages GD(n) of the shift register of the gate unit 242 and the plurality of stages ED(n) of the inverter of the emission unit 244 may have a cascade connection relationship and may sequentially supply the plurality of gate signals GS(n) and the plurality of emission signals ES(n) to pixels P of a display panel through nodes of the stages GD(n) and ED(n).

Each of the stages GD(n) of the shift register of the gate unit 242 of the gate driver 240 may include first to eighth transistors and a first capacitor as shown in FIG. 1.

Further, as shown in FIG. 9, each of the plurality of stages ED(n) of the inverter of the emission unit 244 of the gate driver 240 may include ninth to twentieth transistors T9 to T20, a second capacitor C2, and a charge pump capacitor Ccp.

A gate of the ninth transistor T9 is connected to a terminal supplied with the first emission clock ECLK1, a drain of the ninth transistor T9 is connected to a terminal supplied with the emission high potential voltage EVDD, and a source of the ninth transistor T9 is connected to a drain of the tenth transistor T10.

A gate of the tenth transistor T10 is connected to a terminal supplied with a (n−1)th emission signal ES(n−1) or the emission start voltage EVST, the drain of the tenth transistor T10 is connected to the source of the ninth transistor T9, and a source of the tenth transistor T10 is connected to an emission Q node EQ.

A gate of the eleventh transistor T11 is connected to an emission QB node EQB, a drain of the eleventh transistor T11 is connected to the emission Q node EQ, and a source of the eleventh transistor T11 is connected to a terminal supplied with the emission low potential voltage EVSS.

A gate of the twelfth transistor T12 is connected to a terminal supplied with a (n−1)th gate signal GS(n−1), a drain of the twelfth transistor T12 is connected to a terminal supplied with the emission high potential voltage EVDD, and a source of the twelfth transistor T12 is connected to the emission QB node EQB.

A gate of the thirteenth transistor T13 is connected to the emission Q node EQ, a drain of the thirteenth transistor T13 is connected to a terminal supplied with the emission high potential voltage EVDD, and a source of the thirteenth transistor T13 is connected to a drain of the fourteenth transistor T14.

A gate of the fourteenth transistor T14 is connected to the emission QB node EQB, the drain of the fourteenth transistor T14 is connected to the source of the thirteenth transistor T13, and a source of the fourteenth transistor T14 is connected to a drain of the fifteenth transistor T15.

An nth emission signal ES(n) is output from a node between the thirteenth and fourteenth transistors T13 and T14. The second capacitor C2 is connected between the node between the thirteenth and fourteenth transistors T13 and T14 and the emission Q node EQ.

A gate of the fifteenth transistor T15 is connected to the emission QB node EQB, the drain of the fifteenth transistor T15 is connected to the source of the fourteenth transistor T14, and a source of the fifteenth transistor T15 is connected to a terminal supplied with the emission low potential voltage EVSS.

A gate of the sixteenth transistor T16 is connected to a terminal supplied with an nth gate signal GS(n), a drain of the sixteenth transistor T16 is connected to a terminal supplied with the emission reset voltage ERST, and a source of the sixteenth transistor T16 is connected to the emission QB node EQB.

A gate of the seventeenth transistor T17 is connected to the node between the thirteenth and fourteenth transistors T13 and T14, a drain of the seventeenth transistor T17 is connected to a terminal supplied with the emission high potential voltage EVDD, and a source of the seventeenth transistor T17 is connected to a node between the fourteenth and fifteenth transistors T14 and T15.

A gate of the eighteenth transistor T18 is connected to the emission Q node EQ, a drain of the eighteenth transistor T18 is connected to the emission QB node EQB, and a source of the eighteenth transistor T18 is connected to a terminal supplied with the emission low potential voltage EVSS.

A gate of the nineteenth transistor T19 is connected to an emission Q' node EQ', a drain of the nineteenth transistor T19 is connected to a terminal supplied with the emission high potential voltage EVDD, and a source of the nineteenth transistor T19 is connected to the emission QB node EQB.

The charge pump capacitor Ccp is connected between the fourth emission clock ECLK4 and the emission Q' node EQ'.

A gate of the twentieth transistor T20 is connected to a terminal supplied with the emission start voltage EVST or the (n−1)th emission signal ES(n−1), a drain of the twentieth transistor T20 is connected to the emission Q' node EQ', and a source of the twentieth transistor T20 is connected to a terminal supplied with the emission low potential voltage EVSS.

The embodiment of the invention described that the plurality of transistors of the gate unit 242 and the emission unit 244 is n-type transistors, by way of example. However, the embodiment of the invention is not limited thereto. In another embodiment, the plurality of transistors of the gate unit 242 and the emission unit 244 may be p-type transistors.

As shown in FIG. 10 that illustrates operation timing of the emission unit 244, at a first timing TM1, when the (n−1)th gate signal GS(n−1) or the gate start voltage GVST is generated at a high level, the emission QB node EQB is at a high level. Hence, the fourteenth and fifteenth transistors T14 and T15 are turned on. Further, the emission low potential voltage EVSS is output to the nth emission signal ES(n) of a low level, and an initial voltage Vinit is applied to a third node N3 of each pixel P.

At a second timing TM2, when the (n−1)th emission signal ES(n−1) (or the emission start voltage EVST) and the first emission clock ECLK1 are generated at a high level, the ninth and tenth transistors T9 and T10 are turned on. Hence, the emission Q node EQ is at a high level. Further, the thirteenth transistor T13 is turned on. Hence, the emission high potential voltage EVDD is output to the nth emission signal ES(n) of a high level, and a voltage is sensed at the third node N3 of each pixel P.

At a third timing TM3, when the nth gate signal GS(n) and the emission reset voltage ERST are generated at a high level, the emission QB node EQB is at a high level. Hence, the fourteenth and fifteenth transistors T14 and T15 are turned on. Further, the emission low potential voltage EVSS is output to the nth emission signal ES(n) of a low level, and image data is modulated so that a change in characteristics of each pixel P is reflected.

At a fourth timing TM4, when the (n−1)th emission signal ES(n−1) (or the emission start voltage EVST) and the first emission clock ECLK1 are generated at a high level, the ninth and tenth transistors T9 and T10 are turned on. Hence, the emission Q node EQ is at a high level. Further, the thirteenth transistor T13 is turned on. Hence, the emission high potential voltage EVDD is output to the nth emission signal ES(n) of a high level, and a light emitting diode De of each pixel P is in an on-state and emits light.

In this instance, the twentieth transistor T20 is turned on by the (n−1)th emission signal ES(n−1) of a high level (or the emission start voltage EVST of a high level), and thus the emission Q' node EQ' is at a low level. Further, the eighteenth transistor T18 is turned on by the emission Q node EQ of the high level, and thus the emission QB node EQB is at a low level.

Before a fifth timing TM5, the twentieth transistor T20 is turned off by the (n−1)th emission signal ES(n−1) of a low level (or the emission start voltage EVST of a low level), and thus the emission Q' node EQ' is floated. At the fifth timing TM5, when the fourth emission clock ECLK4 is generated at a high level, the emission Q' node EQ' is charged with the fourth emission clock ECLK4 of the high level through the charge pump capacitor Ccp. Hence, the nineteenth transistor T19 is turned on. Further, the emission QB node EQB is at a high level, and the fourteenth and fifteenth transistors T14 and T15 are turned on. The emission low potential voltage EVSS is output to the nth emission signal ES(n) of a low level, and the light emitting diode De of each pixel P is in an off-state and does not emit light.

As described above, the OLED display according to the second embodiment of the invention divides one frame F into a compensation period CP and a display period DP and drives the pixels P. Further, the OLED display according to the second embodiment of the invention senses a threshold voltage of a driving transistor Td during the compensation period CP to modulate image data and displays an image using the modulated image data during the display period DP.

The display period DP is divided into an emission period EP and a non-emission period NEP. The emission Q' node EQ' is charged with a high level using the emission clock and the charge pump capacitor Ccp depending on the swing between a high level and a low level of the (n−1)th emission signal ES(n−1) (or the emission start voltage EVST) during the non-emission period NEP, and thus can continuously apply a high level to the emission QB node EQB. Further, the OLED display can allow the emission signal ES(n) output from the emission unit 244 of the gate driver 240 to have a low level during the non-emission period NEP.

Namely, a separate shift register (the second shift register in the first embodiment) is omitted in the gate unit 242, and the gate of the nineteenth transistor T19 connected between the emission high potential voltage EVDD and the emission QB node EQB changes from the floating state to the high level state using the fourth emission clock CLK4 used in the emission unit 244 and the charge pump capacitor Ccp. Hence, a length of the emission period EP (or a length ratio of the emission period EP to the non-emission period NEP) in each pixel P can be controlled in a state where an increase in power consumption, an increase in a bezel area, and signal distortion are prevented. Further, the display quality of the OLED display can be improved, and the OLED display can be easily applied to a high resolution display.

For example, the second embodiment of the invention uses a passive element, such as the charge pump capacitor Ccp, as a charge pump element, in order to change a voltage of the emission Q' node EQ' corresponding to the gate of the nineteenth transistor T19 connected between the emission high potential voltage EVDD and the emission QB node EQB. However, the embodiment of the invention is not limited thereto. In another embodiment, an active element such as a charge pump thin film transistor including a MOS capacitor between a gate and an active layer of the charge pump thin film transistor may be used as the charge pump element.

Further, the second embodiment of the invention described the emission unit 244 applied to the pixel P including four transistors and two capacitors by way of example. However, the embodiment of invention is not limited thereto. In another embodiment, the emission unit, that can control the length of the emission period by the charge pumping, may be applied to a pixel including six transistors and one capacitor.

For example, the OLED display according to the second embodiment of the invention uses 5-phase of the first to fifth emission clocks ECLK1 to ECLK5. However, the embodiment of invention is not limited thereto. In another embodiment in which there is no compensation for a change in characteristics, only first and second emission clocks may be used. This is described below.

Figure 11:
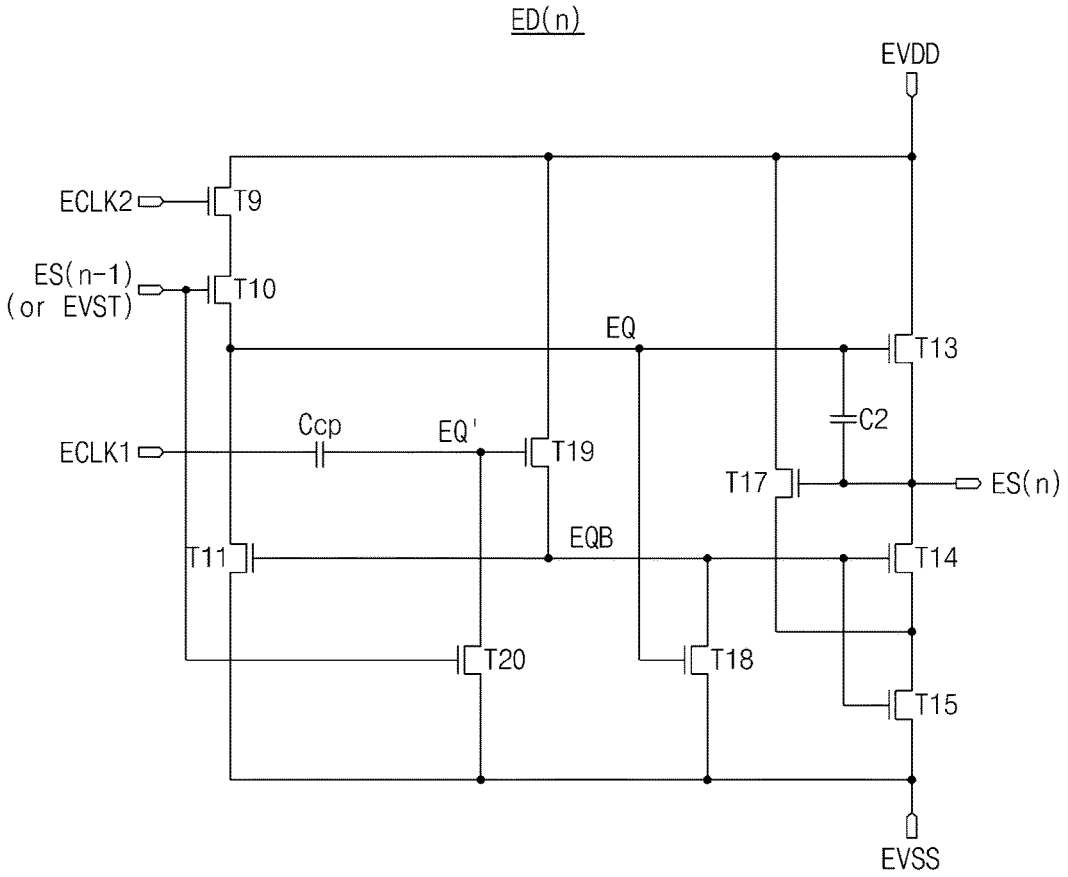
FIG. 11 illustrates a stage of an emission unit of a gate driver of an OLED display according to a third embodiment of the invention.
Figure 12:
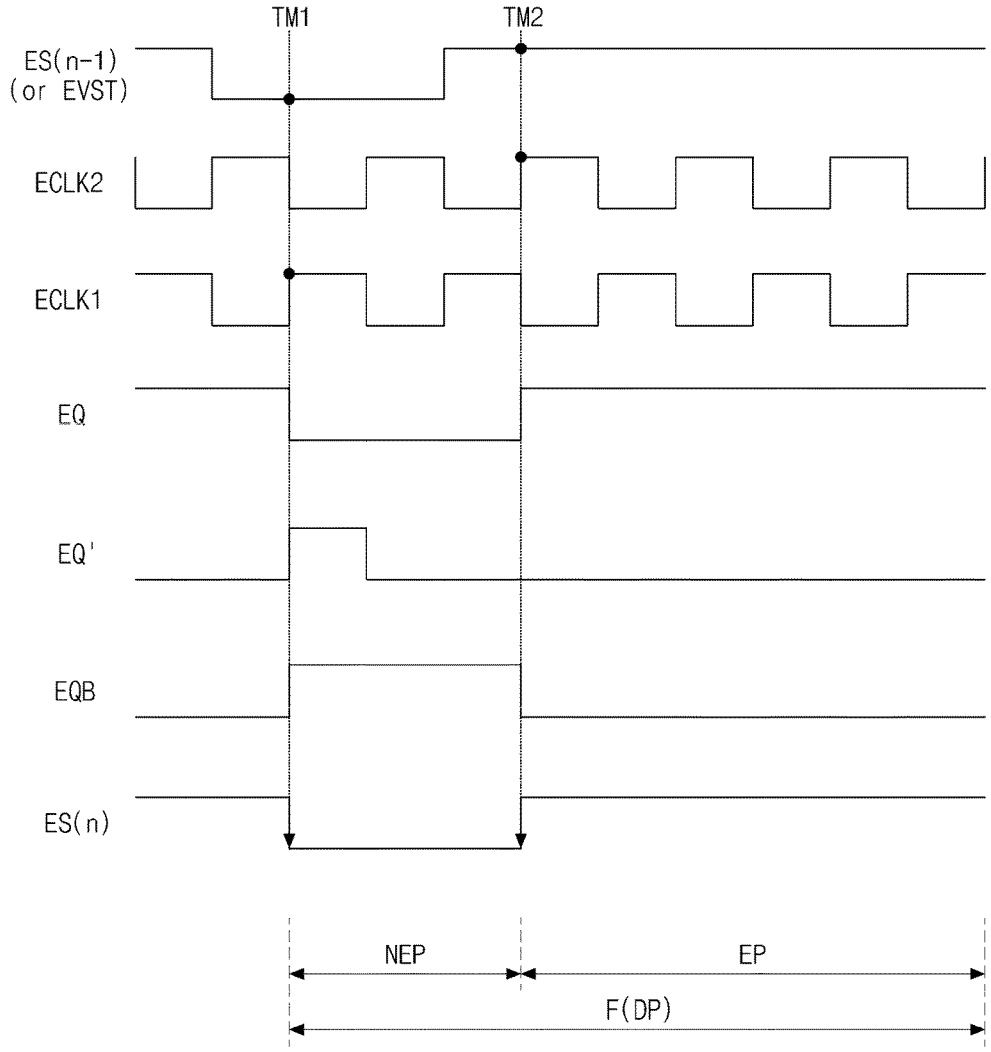
FIG. 12 is a timing diagram of signals related to a stage of an emission unit of a gate driver of an OLED display according to a third embodiment of the invention.

FIG. 11 illustrates a stage of an emission unit of a gate driver of an OLED display according to a third embodiment of the invention. FIG. 12 is a timing diagram of signals related to a stage of an emission unit of a gate driver of an OLED display according to a third embodiment of the invention. Since entire configuration of the OLED display according to the third embodiment of the invention are substantially the same as the OLED display according to the first embodiment of the invention, a further description may be briefly made or may be entirely omitted.

Although not shown, a pixel of an OLED display according to a third embodiment of the invention may have a structure in which the initial transistor T1 is omitted in the pixel according to the first embodiment illustrated in FIG. 4. In the third embodiment of the invention, a length of an emission period of each pixel can be controlled through a gate driver.

A gate driver of the OLED display according to the third embodiment of the invention includes a gate unit generating a plurality of gate signals and an emission unit generating a plurality of emission signals using a start voltage, a clock, a reset voltage, a high potential voltage, and a low potential voltage. The gate unit includes a shift register including a plurality of stages, and the emission unit includes an inverter including a plurality of stages ED(n).

Each stage of the shift register of the gate unit of the gate driver may include first to eighth transistors and a first capacitor as shown in FIG. 1.

As shown in FIG. 11, each of the plurality of stages ED(n) of the inverter of the emission unit of the gate driver may include ninth to eleventh transistors T9 to T11, thirteenth to fifteenth transistors T13 to T15, seventeenth to twentieth transistors T17 to T20, a second capacitor C2, and a charge pump capacitor Ccp.

Each stage ED(n) of the emission unit according to the third embodiment of the invention has substantially the same connection configuration as each stage ED(n) of the emission unit 244 according to the second embodiment illustrated in FIG. 9, except that twelfth and sixteenth transistors T12 and T16 are omitted, and a gate of the ninth transistor T9 is connected to a terminal supplied with a second emission clock ECLK2. Therefore, a further description may be briefly made or may be entirely omitted.

As shown in FIG. 12 that illustrates operation timing of the emission unit, before a first timing TM1, the twelfth transistor T20 is turned off by a (n−1)th emission signal ES(n−1) of a low level (or an emission start voltage EVST), and thus an emission Q' node EQ' of a low level is floated. At the first timing TM1, when a first emission clock ECLK1 is generated at a high level, the emission Q' node EQ' is charged with the first emission clock ECLK1 of the high level through the charge pump capacitor Ccp. Hence, the nineteenth transistor T19 is turned on. Further, an emission QB node EQB is at a high level, and thus the fourteenth and fifteenth transistors T14 and T15 are turned on. An emission low potential voltage EVSS is output to an nth emission signal ES(n) of a low level, and a light emitting diode De of each pixel P is in an off-state and does not emit light.

At a second timing TM2, when the (n−1)th emission signal ES(n−1) (or the emission start voltage EVST) and the second emission clock ECLK2 are generated at a high level, the ninth and tenth transistors T9 and T10 are turned on. Hence, an emission Q node EQ is at a high level. Further, the thirteenth transistor T13 is turned on. Hence, an emission high potential voltage EVDD is output to the nth emission signal ES(n) of a high level, and the light emitting diode De of each pixel P is in an on-state and emits light.

In the OLED display according to the third embodiment of the invention, the pixels P are driven using an entire duration of one frame F as a display period DP, and the display period DP is divided into an emission period EP and a non-emission period NEP. The emission Q' node EQ' is charged with a high level using the emission clock and the charge pump capacitor Ccp depending on the swing between a high level and a low level of the (n−1)th emission signal ES(n−1) (or the emission start voltage EVST) during the non-emission period NEP, and thus can continuously apply a high level to the emission QB node EQB. Further, the OLED display can allow the emission signal ES(n) output from the emission unit of the gate driver to have a low level during the non-emission period NEP.

Namely, a separate shift register (the second shift register in the first embodiment) is omitted in the gate unit, and the gate of the nineteenth transistor T19 connected between the emission high potential voltage EVDD and the emission QB node EQB changes from the floating state to the high level state using the first emission clock CLK1 used in the emission unit and the charge pump capacitor Ccp. Hence, a length of the emission period EP (or a length ratio of the emission period EP to the non-emission period NEP) in each pixel P can be controlled in a state where an increase in power consumption, an increase in a bezel area, and signal distortion are prevented. Further, the display quality of the OLED display can be improved, and the OLED display can be easily applied to a high resolution display.

For example, the third embodiment of the invention uses a passive element, such as the charge pump capacitor Ccp, as a charge pump element, in order to change a voltage of the emission Q' node EQ' corresponding to the gate of the nineteenth transistor T19 connected between the emission high potential voltage EVDD and the emission QB node EQB. However, the embodiment of the invention is not limited thereto. In another embodiment, an active element such as a charge pump thin film transistor including a MOS capacitor between a gate and an active layer of the charge pump thin film transistor may be used as the charge pump element.

The first to third embodiments of the invention described a gate driver applied to N-type 4T2C pixel structure, by way of example. As described above, the emission unit according to the second embodiment illustrated in FIG. 9 and the emission unit according to the third embodiment illustrated in FIG. 11 may be applied to a shift register for driving an OLED display having P-type 6T1C pixel structure.

Hereinafter, embodiments, in which a gate driver is applied to an OLED display having 6T1C pixel structure, are described.

An OLED display having 6T1C pixel structure is described with reference to FIGS. 13 and 14.

Figure 13:
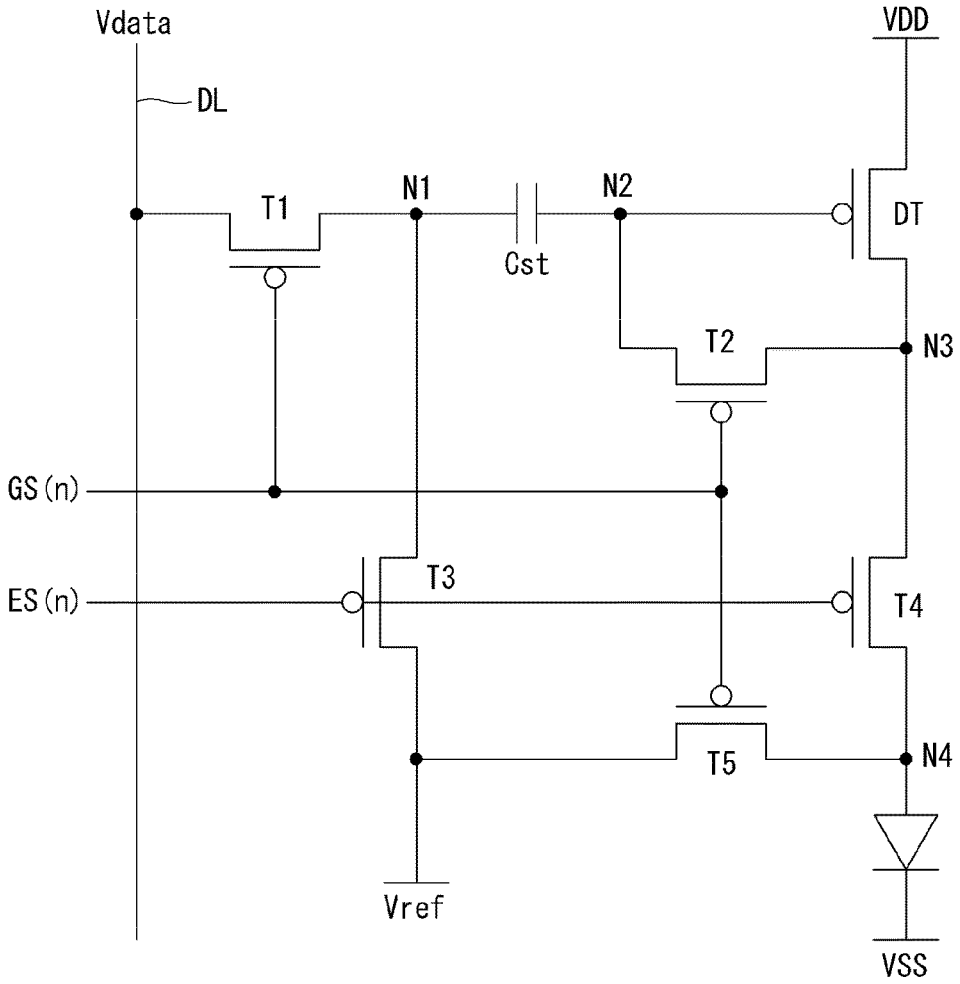
FIG. 13 illustrates a pixel of an OLED display according to a second embodiment of the invention.
Figure 14:
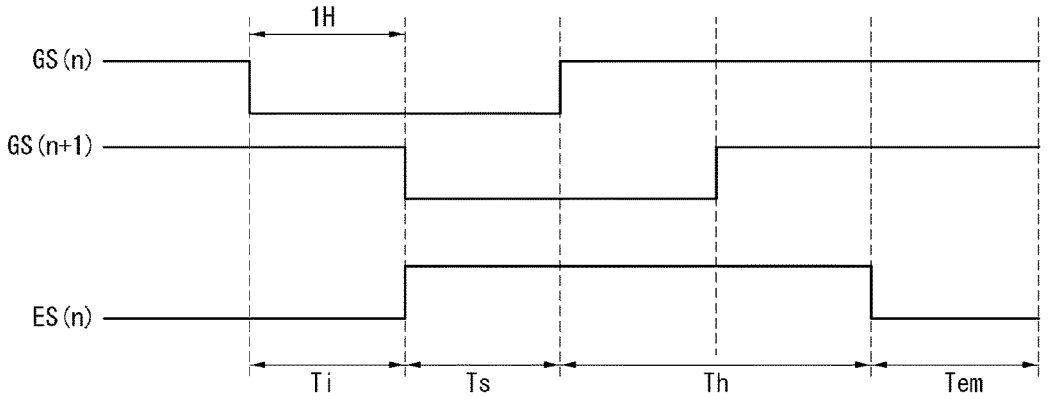
FIG. 14 is a timing diagram of driving signals for driving a pixel shown in FIG. 13.

FIG. 13 illustrates a pixel of the OLED display according to the second embodiment of the invention, and FIG. 14 is a timing diagram of driving signals for driving a pixel shown in FIG. 13.

Referring to FIG. 13, each pixel according to the second embodiment of the invention includes an organic light emitting diode DE, a driving transistor DT, first to fifth transistors T1 to T5, and a capacitor Cst.

The organic light emitting diode DE emits light by a driving current supplied from the driving transistor DT. Multi-layered organic compound layers are formed between an anode electrode and a cathode electrode of the organic light emitting diode DE. The anode electrode of the organic light emitting diode DE is connected to a fourth node N4, and the cathode electrode of the organic light emitting diode DE is connected to an input terminal of a low potential voltage VSS.

The driving transistor DT controls the driving current applied to the organic light emitting diode DE depending on a source-to-gate voltage Vsg of the driving transistor DT. A source electrode of the driving transistor DT is connected to an input terminal of a high potential voltage VDD, a gate electrode of the driving transistor DT is connected to a second node N2, and a drain electrode of the driving transistor DT is connected to a third node N3.

The first transistor T1 includes a gate connected to an input terminal of a gate signal GS, a source connected to a data line DL used to supply a data voltage Vdata, and a drain connected to a first node N1. As a result, the first transistor T1 applies the data voltage Vdata supplied from the data line DL to the first node N1 in response to the gate signal GS.

The second transistor T2 includes a source connected to the third node N3, a drain connected to the second node N2, and a gate connected to the input terminal of the gate signal GS. The second transistor T2 diode-connects the gate electrode and the drain electrode of the driving transistor DT in response to the gate signal GS.

The third transistor T3 includes a gate connected to an input terminal of an emission signal ES, a source connected to the first node N1, and a drain connected to an input terminal of a reference voltage Vref. As a result, the third transistor T3 applies the reference voltage Vref to the first node N1 in response to the emission signal ES.

The fourth transistor T4 includes a source connected to the third node N3, a drain connected to the fourth node N4, and a gate connected to the input terminal of the emission signal ES. As a result, the fourth transistor T4 forms a current path between the third node N3 and the fourth node N4 in response to the emission signal ES.

The fifth transistor T5 includes a drain connected to the fourth node N4, a source connected to the input terminal of the reference voltage Vref, and a gate connected to the input terminal of the gate signal GS. The fifth transistor T5 applies the reference voltage Vref to the fourth node N4 in response to the gate signal GS.

The storage capacitor Cst includes a first electrode connected to the first node N1 and a second electrode connected to the second node N2.

A drive of the OLED display according to the second embodiment of the invention is described with reference to FIGS. 13 and 14.

In the OLED display according to the second embodiment of the invention, one frame period may be divided into an initial period T1, a sampling period Ts, and an emission period Tem. The initial period T1 is a period in which a gate voltage of the driving transistor DT is initialized. The sampling period Ts is a period in which a voltage of the anode electrode of the organic light emitting diode DE is initialized, and a threshold voltage Vth of the driving transistor DT is sampled and stored in the second node N2. The emission period Tem is a period in which a source-to-gate voltage of the driving transistor DT including the sampled threshold voltage Vth is programmed, and the organic light emitting element DE emits light using a driving current corresponding to the programmed source-to-gate voltage.

During the initial period T1, an nth gate signal GS(n) and an nth emission signal ES(n) are applied as a gate-on voltage. As a result, the first transistor T1 and the second transistor T2 are turned on by the nth gate signal GS(n), and the third to fifth transistors T3 to T5 are turned on by the nth emission signal ES(n). During the initial period T1, the first node N1 are simultaneously supplied with the reference voltage Vref and the data voltage Vdata, and the second to fourth nodes N2 to N4 are initialized by the reference voltage Vref. The reference voltage Vref may be selected within a voltage range sufficiently less than an operating voltage of the organic light emitting diode DE and may be set to a voltage equal to or less than the low potential voltage VSS.

During the sampling period Ts, the nth gate signal GS(n) is held at a gate-on voltage, and the nth emission signal ES(n) is inverted to a gate-off voltage. As a result, the first transistor T1, the second transistor T2, and the fifth transistor T5 maintain a turn-on state, and the third transistor T3 and the fourth transistor T4 are turned off.

When the third transistor T3 is turned on, a voltage of the first node N1 increases by the data voltage Vdata passing through the first transistor T1. A voltage of the second node N2 increases as the voltage of the first node N1 increases. As a result, the driving transistor DT is turned on as a voltage difference between the gate electrode and the source electrode of the driving transistor DT is equal to or greater than the threshold voltage Vth of the driving transistor DT.

A voltage of the third node N3 gradually increases by a current passing through the source electrode and the drain electrode of the driving transistor DT. Because the gate electrode and the drain electrode of the driving transistor DT are diode-connected, the voltage of the second node N2 increases depending on a voltage of the third node N3. As the voltage of the second node N2 increases, the voltage difference between the gate electrode and the source electrode of the driving transistor DT gradually decreases. When the voltage difference between the gate electrode and the source electrode of the driving transistor DT is equal to or less than the threshold voltage Vth of the driving transistor DT, the driving transistor DT is turned off. As a result, during the sampling period Ts, the second node N2 and the third node N3 have a voltage "VDD+Vth" corresponding to a difference between the high potential voltage VDD and the threshold voltage Vth.

During the sampling period Ts, the first transistor T1 charges the first node N1 with the data voltage Vdata in response to the nth gate signal GS(n).

During the sampling period Ts, the fifth transistor T5 initializes the fourth node N4 to the reference voltage Vref in response to the nth gate signal GS(n).

During a holding period Th, the nth gate signal GS(n) is inverted to the gate-off voltage, and the nth emission signal ES(n) is held at the gate-off voltage. As a result, the voltages of the first to fourth nodes N1 to N4 hold the voltage of the sampling period Ts.

During the emission period Tem, the nth gate signal GS(n) is held at the gate-off voltage, and the nth emission signal ES(n) is inverted to the gate-on voltage.

The third transistor T3 applies the reference voltage Vref to the first node N1 in response to the nth emission signal ES(n). Because the voltage of the first node N1 is the data voltage Vdata during the sampling period Ts, a voltage change amount of the first node N1 is "Vdata−Vref". The voltage change amount of the first node N1 is reflected on the second node N2 by the coupling between the second node N2 and the first node N1, and thus the voltage of the second node N2 is "VDD−Vth−(Vdata−Vref)". A driving current IDE passing through the source electrode and the drain electrode of the driving transistor DT in accordance with the voltage change of the second node N2 is applied to the organic light emitting diode DE via the fourth node N4.

During the emission period Tem, the driving current IDE flowing in the organic light emitting diode DE is expressed by the following Equation 1.

$$IDE=k/2(Vgs-|Vth|)^2=k/2(Vg-Vs-|Vth|)^2=k/2\{(VDD+Vth-Vdata+Vref-VDD-|Vth|)^2=k/2(Vref-Vdata)^2 \quad \text{[Equation 1]}$$

In Equation 1, k/2 is a proportional constant determined by electron mobility, a parasitic capacitance, channel capacity, etc. of the driving transistor DT.

As indicated by Equation 1, the threshold voltage Vth of the driving transistor DT is erased in Equation 1 of the driving current IDE. This means that the driving current IDE of the OLED display according to the embodiment of the invention does not change even if the threshold voltage Vth of the driving transistor DT changes.

As described above, the OLED display according to the embodiment of the invention can program the data voltage Vdata irrespective of a change amount of the threshold voltage Vth during the sampling period Ts.

Figure 15:
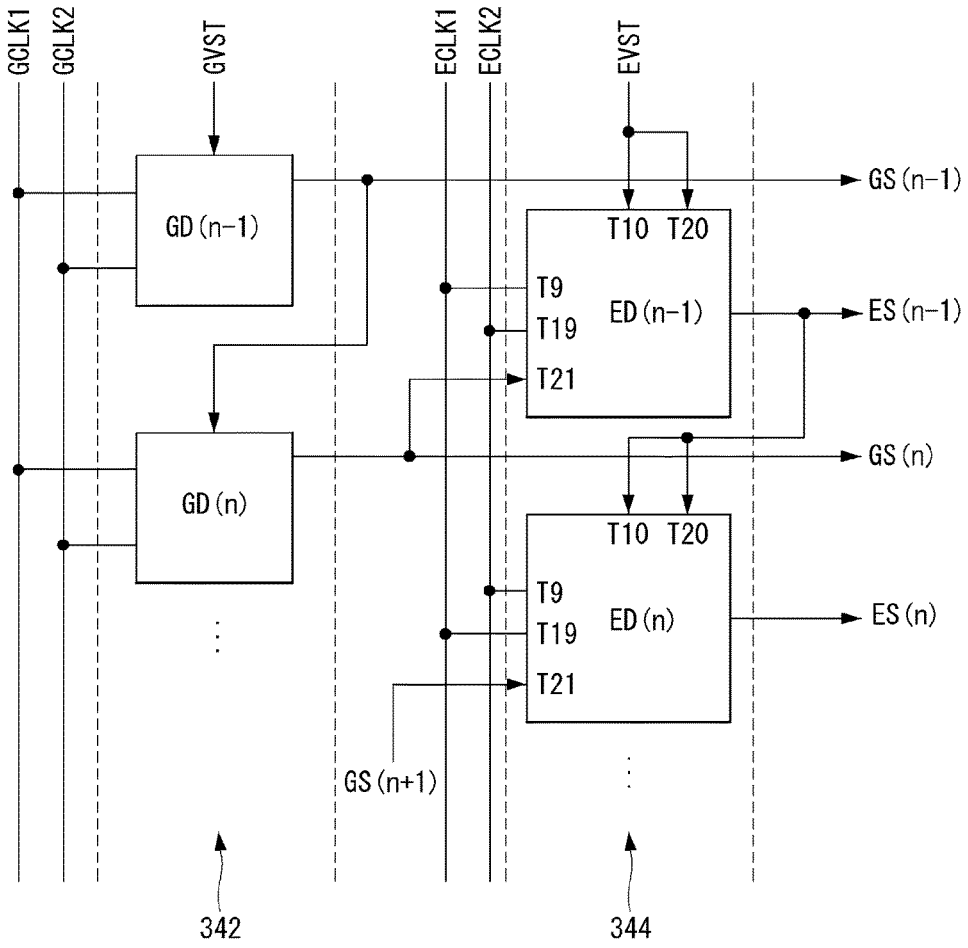
FIG. 15 illustrates a gate driver according to a third embodiment of the invention.

FIG. 15 illustrates a gate driver according to the third embodiment of the invention. More specifically, FIG. 15 illustrates a gate driver for generating the gate signal and the emission signal shown in FIG. 14.

Referring to FIG. 15, a gate driver of the OLED display according to the third embodiment of the invention includes a gate unit 342 generating a plurality of gate signals GS and an emission unit 344 generating a plurality of emission signals ES using a start voltage, a clock, a reset voltage, a high potential voltage, and a low potential voltage.

The gate unit 342 includes a plurality of cascade-connected gate stages GD, and the emission unit 344 includes a plurality of cascade-connected emission stages ED.

Each gate stage GD of the gate unit 342 generates the gate signal GS using a gate start voltage GVST or an output GS(n−1) of a previous gate stage, first and second gate clocks GCLK1 and GCLK2, a gate high potential voltage GVDD, and a gate low potential voltage GVSS. For example, an nth gate stage GD(n) of the gate unit 342 generates an nth gate signal GS(n) using a (n−1)th gate signal GS(n−1), the first and second gate clocks GCLK1 and GCLK2, the gate high potential voltage GVDD, and the gate low potential voltage GVSS.

Each emission stage ED of the emission unit 344 generates the emission signal ES using an emission start voltage EVST or an output ES(n−1) of a previous emission stage, first to fifth emission clocks ECLK1 to ECLK5, an emission reset voltage ERST, an emission high potential voltage VEH, and an emission low potential voltage VEL. For example, an nth emission stage ED(n) of the emission unit 344 generates an nth emission signal ES(n) using the emission start voltage EVST, a (n−1)th emission signal ES(n−1), the first and second emission clocks ECLK1 and ECLK2, the emission high potential voltage VEH, and the emission low potential voltage VEL.

The gate stages GD of the gate unit 342 and the emission stages ED of the emission unit 344 may sequentially supply the gate signals GS and the emission signals ES to the pixels of the display panel.

The gate stages GD of the gate unit 342 may output the same gate signal GS as that shown in FIG. 14, and detailed circuit configuration of the gate stage GD may use any known circuit configuration.

Figure 16:
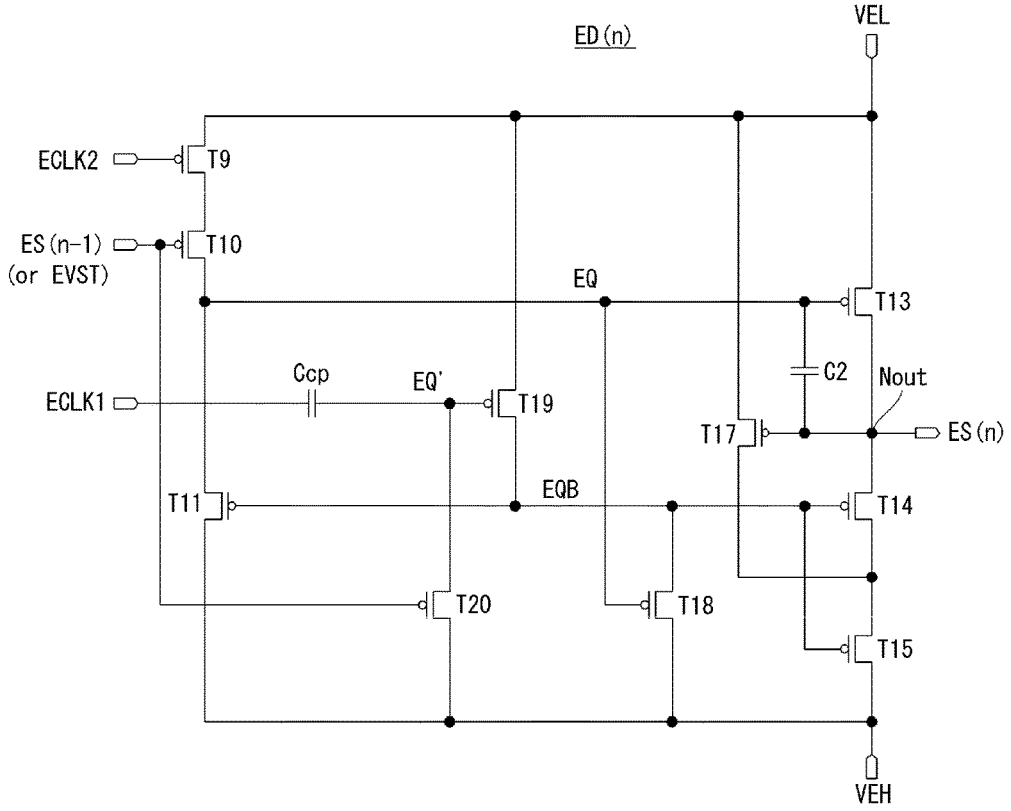
FIG. 16 illustrates a stage of an emission unit according to a fourth embodiment of the invention.
Figure 17:
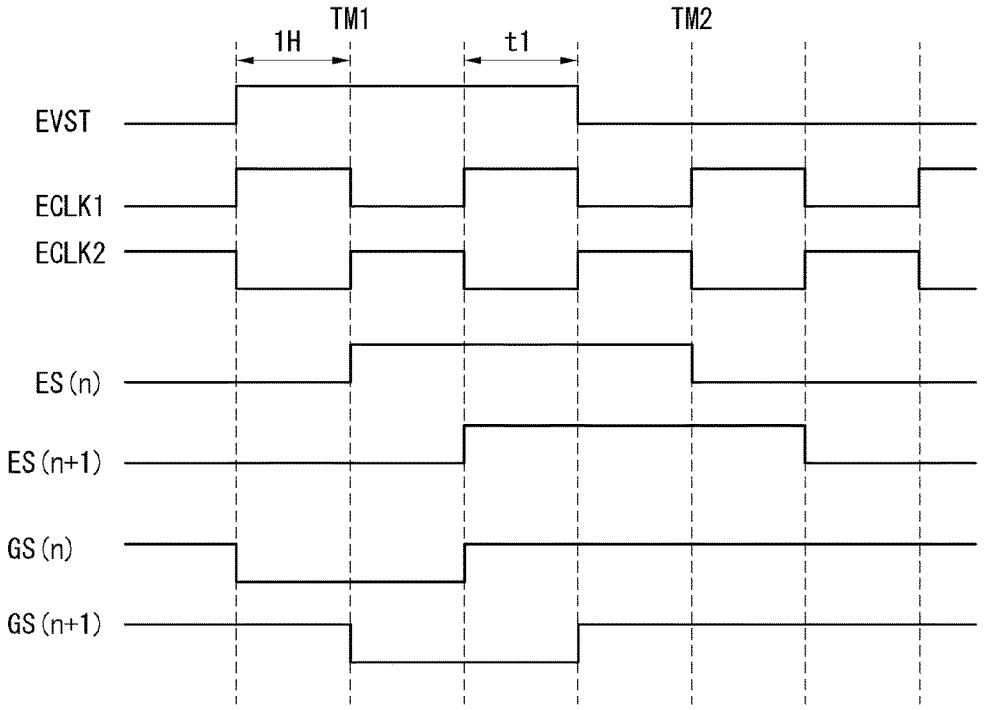
FIG. 17 is a timing diagram of signals related to a stage of an emission unit shown in FIG. 16.

FIG. 16 illustrates an emission unit according to a fourth embodiment of the invention. The emission unit according to the fourth embodiment of the invention is substantially the same as the emission unit according to the third embodiment illustrated in FIG. 11, except that transistors are P-type transistors. FIG. 17 illustrates driving signals for driving the emission unit shown in FIG. 16. FIG. 16 illustrates PMOS transistors by way of example. Therefore, a gate-on voltage is an emission low potential voltage VEL, and a gate-off voltage is an emission high potential voltage VEH.

Referring to FIG. 16, an nth stage ED(n) of the emission unit according to the fourth embodiment of the invention includes ninth to fifteenth transistors T9 to T15, seventeenth to twentieth transistors T17 to T20, a second capacitor C2, and a charge pump capacitor Ccp.

A start controller (T9 and T10) charges an emission Q node EQ with the gate-on voltage in a period in which an emission start voltage EVST and a first emission clock ECLK1 are synchronized. The start controller (T9 and T10) includes the ninth transistor T9 and the tenth transistor T10.

A gate of the ninth transistor T9 is connected to a terminal supplied with the first emission clock ECLK1, a drain of the ninth transistor T9 is connected to a terminal supplied with the emission low potential voltage VEL, and a source of the ninth transistor T9 is connected to a drain of the tenth transistor T10.

A gate of the tenth transistor T10 is connected to a terminal supplied with a (n−1)th emission signal ES(n−1) or the emission start voltage EVST, the drain of the tenth transistor T10 is connected to the source of the ninth transistor T9, and a source of the tenth transistor T10 is connected to an emission Q node EQ.

A gate of the eleventh transistor T11 is connected to an emission QB node EQB, a drain of the eleventh transistor T11 is connected to the emission Q node EQ, and a source of the eleventh transistor T11 is connected to a terminal supplied with the emission high potential voltage VEH.

A gate of the twelfth transistor T12 is connected to a terminal supplied with a (n−1)th gate signal GS(n−1), a drain of the twelfth transistor T12 is connected to a terminal supplied with the emission high potential voltage VEH, and a source of the twelfth transistor T12 is connected to the emission QB node EQB.

A pull-up transistor (hereinafter, referred to as "thirteenth transistor") T13 outputs a voltage of an output terminal Nout as the gate-on voltage in response to a voltage of the emission Q node EQ. A gate of the thirteenth transistor T13 is connected to the emission Q node EQ, a drain of the thirteenth transistor T13 is connected to a terminal supplied with the emission high potential voltage VEH, and a source of the thirteenth transistor T13 is connected to a drain of the fourteenth transistor T14.

Pull-down transistors T14 and T15 output a voltage of the output terminal Nout as the gate-off voltage in response to a voltage of the emission QB node EQB. A gate of the fourteenth transistor T14 is connected to the emission QB node EQB, the drain of the fourteenth transistor T14 is connected to the source of the thirteenth transistor T13, and a source of the fourteenth transistor T14 is connected to a drain of the fifteenth transistor T15.

An nth emission signal ES(n) is output through the output terminal Nout. The second capacitor C2 is connected between a node between the thirteenth and fourteenth transistors T13 and T14 and the emission Q node EQ.

A gate of the fifteenth transistor T15 is connected to the emission QB node EQB, the drain of the fifteenth transistor T15 is connected to the source of the fourteenth transistor T14, and a source of the fifteenth transistor T15 is connected to a terminal supplied with the emission high potential voltage VEH.

A gate of the seventeenth transistor T17 is connected to the node between the thirteenth and fourteenth transistors T13 and T14, a drain of the seventeenth transistor T17 is connected to a terminal supplied with the emission low potential voltage VEL, and a source of the seventeenth transistor T17 is connected to a node between the fourteenth and fifteenth transistors T14 and T15.

A gate of the eighteenth transistor T18 is connected to the emission Q node EQ, a drain of the eighteenth transistor T18 is connected to the emission QB node EQB, and a source of the eighteenth transistor T18 is connected to a terminal supplied with the emission high potential voltage VEH.

A first QB node control transistor (hereinafter referred to as "nineteenth transistor") T19 charges the emission QB node EQB with the gate-on voltage in response to a voltage of an emission Q' node EQ'. A gate of the nineteenth transistor T19 is connected to the emission Q' node EQ', a drain of the nineteenth transistor T19 is connected to a terminal supplied with the emission low potential voltage VEL, and a source of the nineteenth transistor T19 is connected to the emission QB node EQB.

A gate of the twentieth transistor T20 is connected to a terminal supplied with the emission start voltage EVST or the (n−1)th emission signal ES(n−1), a drain of the twentieth transistor T20 is connected to the emission Q' node EQ', and a source of the twentieth transistor T20 is connected to a terminal supplied with the emission high potential voltage VEH.

The charge pump capacitor Ccp is connected between the first emission clock ECLK1 and the emission Q' node EQ'.

An operation of the nth emission stage ED(n) is described below with reference to FIG. 17.

A first timing TM1 is a time at which the sampling period Ts shown in FIG. 14 starts. At the first timing TM1, when the first emission clock ECLK1 is inverted to a low level, the first emission clock ECLK1 of the low level is charged to the emission Q' node EQ' through the charge pump capacitor Ccp. The nineteenth transistor T19 charges the emission QB node EQB with the emission low potential voltage VEL in response to a voltage of the emission Q' node EQ' of the low level that is the gate-on voltage. The fourteenth and fifteenth transistors T14 and T15 charge the output terminal Nout with the emission high potential voltage VEH, that is the gate-off voltage, in response to a voltage of the emission QB node EQB of the low level that is the gate-on voltage.

At a second timing TM2, when the second emission clock ECLK2 and the (n−1)th emission signal ES(n−1) (or the emission start voltage EVST) are generated at a low level, the ninth and tenth transistors T9 and T10 are turned on. Hence, the emission Q node EQ is at a low level. As a result, the thirteenth transistor T13 is turned on, and the emission low potential voltage VEL is output to the nth emission signal ES(n) through the output terminal Nout.

The emission unit according to the fourth embodiment of the invention charges the emission Q' node EQ' with the gate-on voltage of the low level using the charge pump capacitor Ccp and thus can continuously apply a high level to the emission QB node EQB.

In this instance, after the nineteenth transistor T19 is turned on by the first emission clock ECLK1 at the first timing TM1, the first emission clock ECLK1 is inverted to the gate-off voltage during a first period t1. If there is no charge pump capacitor Ccp, the nineteenth transistor T19 may be turned off because the emission Q' node EQ' is the gate-off voltage. During the first period t1, the emission QB node EQB has to hold the gate-off voltage. However, if the nineteenth transistor T19 is turned off, the voltage of the emission QB node EQB may be unstable.

On the other hand, the embodiment of the invention can prevent the emission Q' node EQ' from being charged with the gate-off voltage during the first period t1 using the charge pump capacitor Ccp. Namely, even if the first emission clock ECLK1 connected to one electrode of the charge pump capacitor Ccp is inverted to a high level, the voltage of the emission Q' node EQ' may slightly change by a coupling effect and can be prevented from sharply changing to the gate-off voltage. As a result, the nineteenth transistor T19 can stably maintain a turn-on state during a period of time from the first timing TM1 to the second timing TM2.

Figure 18:
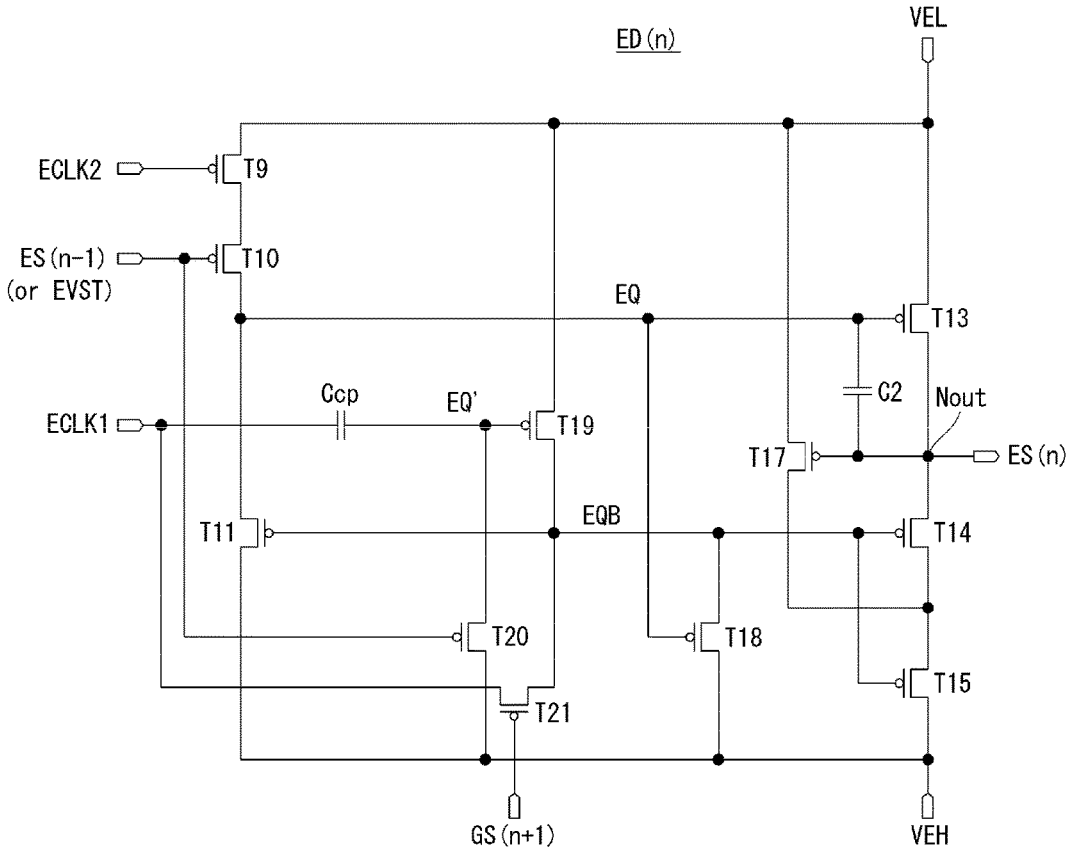
FIG. 18 illustrates a stage of an emission unit according to a fifth embodiment of the invention.

FIG. 18 illustrates an emission unit according to a fifth embodiment of the invention. The fifth embodiment illustrated in FIG. 18 is configured such that a twenty-first transistor T21 is added to the fourth embodiment illustrated in FIG. 16. Structures and components identical or equivalent to those illustrated in FIG. 16 are designated with the same reference numerals in the fifth embodiment illustrated in FIG. 18, and a further description may be briefly made or may be entirely omitted. Further, an emission clock for driving the emission unit shown in FIG. 18 uses the first and second emission clocks ECLK1 and ECLK2 shown in FIG. 17.

Referring to FIGS. 17 and 18, an emission stage ED of the emission unit according to the fifth embodiment of the invention includes ninth to fifteenth transistors T9 to T15, seventeenth to twenty-first transistors T17 to T21, a second capacitor C2, and a charge pump capacitor Ccp.

A second QB node control transistor (hereinafter referred to as "twenty-first transistor") T21 of an nth emission stage ED(n) includes a gate connected to an input terminal supplying a (n+1)th gate signal GS(n+1), a drain connected to an input terminal supplying a first emission clock ECLK1, and a source connected to an emission QB node EQB. The twenty-first transistor T21 charges the emission QB node EQB with a gate-on voltage of the first emission clock ECLK1 in response to the (n+1)th gate signal GS(n+1). As a result, the twenty-first transistor T21 can allow a voltage of the emission QB node EQB to rapidly fall to the gate-on voltage.

An operation of the twenty-first transistor T21 is described in detail below.

As shown in FIG. 17, the fourteenth and fifteenth transistors T14 and T15 of the emission unit have to be turned on as the voltage of the emission QB node EQB is the emission low potential voltage VEL at the first timing TM1.

However, until immediately before the first timing TM1, the voltage of the emission Q node EQ is the emission low potential voltage VEL so that the eighteenth transistor T18 maintains the turn-on state. Therefore, at the first timing TM1, the emission high potential voltage VEH is applied to the emission QB node EQB through the eighteenth transistor T18. As a result, even if the nineteenth transistor T19 is turned on at the first timing TM1, a time at which the voltage of the emission QB node EQB falls to the emission low potential voltage VEL may be delayed.

Figure 19:
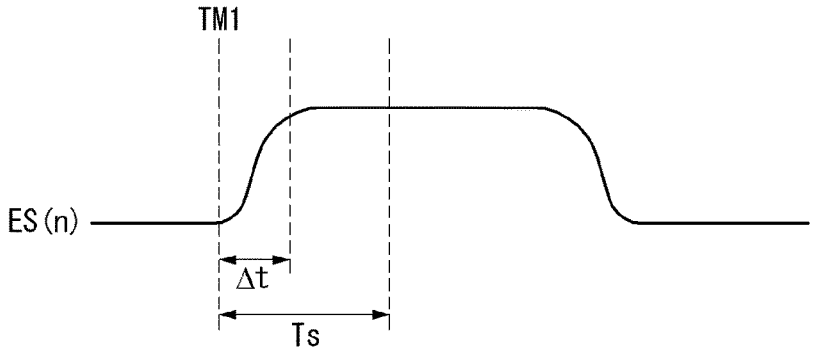
FIG. 19 illustrates a delay of a gate-off voltage of an emission signal.

As the falling time of the emission QB node EQB to the emission low potential voltage VEL is delayed, a turn-on time of the fourteenth and fifteenth transistors T14 and T15 is delayed. Eventually, as shown in FIG. 19, a time at which the nth emission signal ES(n) rises to the emission high potential voltage VEH (i.e., the gate-off voltage) is delayed by a delay time Δt.

The first timing TM1 is a start time of the sampling period Ts shown in FIG. 14. Therefore, a length of the sampling period Ts decreases by the delay time Δt of the nth emission signal ES(n). When the length of the sampling period Ts decreases, the threshold voltage is compensated insufficiently, and a length of an application period of the data voltage decreases. Thus, it is difficult to display an image of a desired luminance.

The twenty-first transistor T21 charges the emission QB node EQB with the voltage of the first emission clock ECLK1 in response to a (n+1)th gate signal GS(n+1). At the first timing TM1, the first emission clock ECLK1 has the low level voltage that is the gate-on voltage. Namely, because the twenty-first transistor T21 charges the emission QB node EQB with the gate-on voltage at the first timing TM1, a time required to charge the emission QB node EQB with the gate-on voltage decreases. As a result, a time, for which the ninth and tenth transistors T9 and T10 are turned on in response to the voltage of the emission QB node EQB, can decrease, and a delay time of the output of the gate-off voltage of the nth emission signal ES(n) can decrease.

Figure 20:
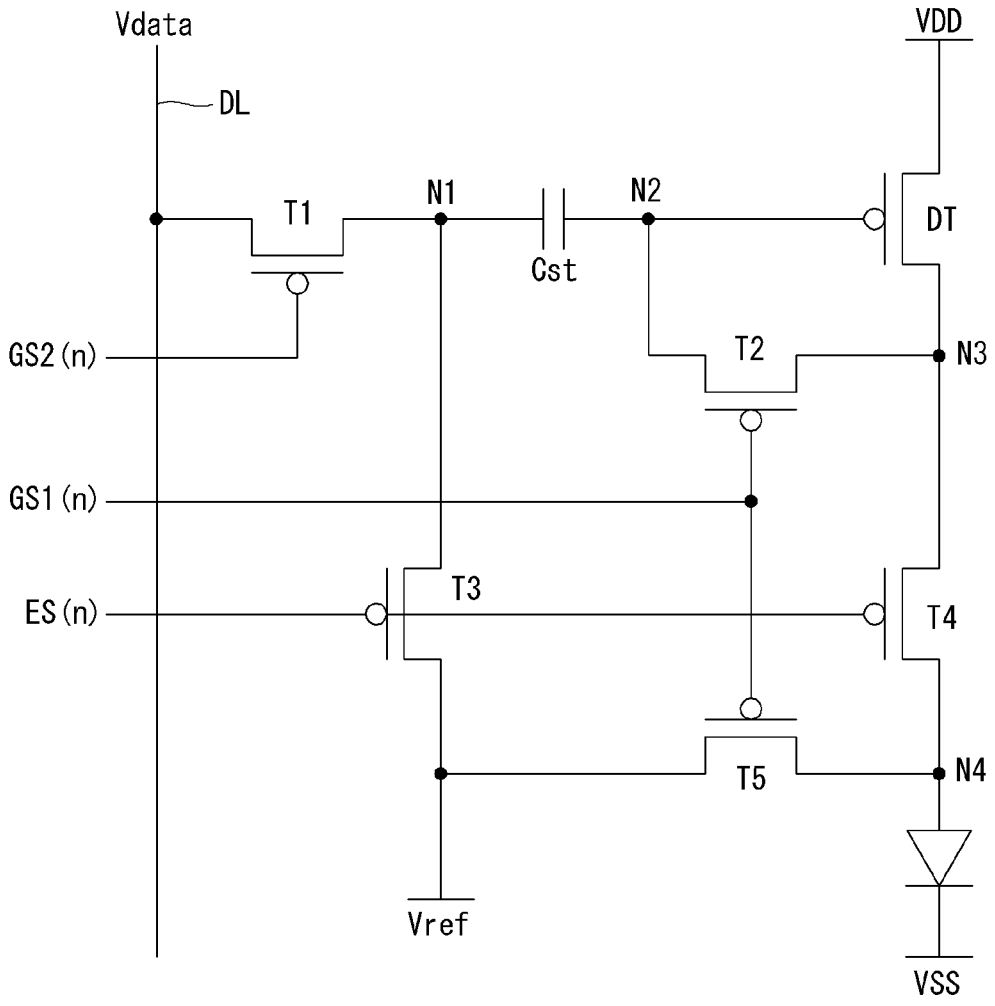
FIG. 20 illustrates a pixel of an OLED display according to a third embodiment of the invention.
Figure 21:
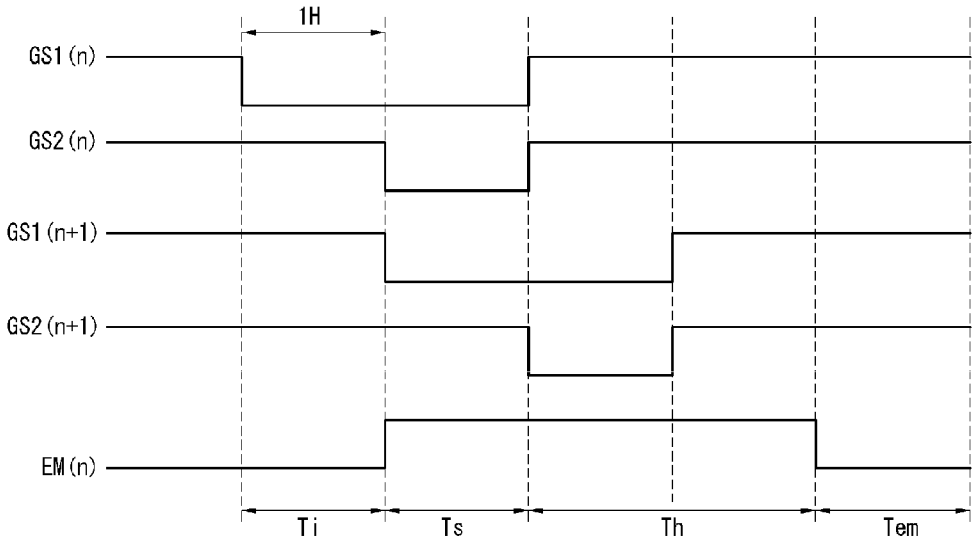
FIG. 21 is a timing diagram of driving signals for driving a pixel shown in FIG. 20.

FIG. 20 illustrates a pixel of the OLED display according to the third embodiment of the invention, and FIG. 21 is a timing diagram of driving signals for driving a pixel shown in FIG. 20.

Referring to FIG. 21, each pixel of the OLED display according to the third embodiment of the invention includes an organic light emitting diode DE, a driving transistor DT, first to fifth transistors T1 to T5, and a capacitor Cst. Structures and components identical or equivalent to those illustrated in FIG. 13 are designated with the same reference numerals in the third embodiment illustrated in FIG. 20, and a further description may be briefly made or may be entirely omitted.

Referring to FIGS. 20 and 21, a gate of the first transistor T1 is connected to an input terminal for supplying a second gate signal GS2(*n*), and gates of the second transistor T2 and the fifth transistor T5 are connected to an input terminal for supplying a first gate signal GS1(*n*).

Namely, during an initial period T1, because the second gate signal GS2(*n*) is held at the gate-off voltage, the first transistor T1 is turned off. As a result, during the initial period T1, a voltage of a first node N1 is initialized to the reference voltage Vref in which the data voltage Vdata is not mixed.

The gate unit to which the embodiment illustrated in FIGS. 20 and 21 is applied may use any known configuration. The emission unit to which the embodiment illustrated in FIGS. 20 and 21 is applied may use the embodiments illustrated in FIGS. 15 to 18. In this instance, a gate of the twenty-first transistor T21 of the emission stage may operate in response to a (n+1)th gate1 signal GS1(*n*+1).

As described above, a length of an emission period of the light emitting diode can be controlled by continuously applying the high potential voltage to the emission QB node of the gate driver.

The embodiment of the invention can control a length of the emission period of the light emitting diode by continuously applying the high potential voltage to the emission QB node of the gate driver using the charge pump capacitor, and can also reduce power consumption and the bezel area and can improve the display quality.

It will be apparent to those skilled in the art that various modifications and variations can be made in the organic light emitting diode display of the present invention without departing from the spirit or scope of the invention. Thus, it is intended that the present invention cover the modifications and variations of this invention provided they come within the scope of the appended claims and their equivalents.

What is claimed is:

1. An organic light emitting diode display, comprising:

a display panel including a plurality of pixels each including an organic light emitting diode;

a data driver configured to supply a plurality of data signals to the plurality of pixels;

a gate driver including a gate unit configured to supply a plurality of gate signals to the plurality of pixels and an emission unit configured to supply a plurality of emission signals to the plurality of pixels using a charge pump element and control a length of an emission period of the organic light emitting diode; and a timing controller configured to supply image data and a data control signal to the data driver and supply a gate control signal to the gate driver, wherein the emission unit includes a plurality of stages, and wherein each stage includes:

a Q node determining whether the plurality of emission signals is output at a high level;

a QB node determining whether the plurality of emission signals is output at a low level;

a Q' node determining whether the QB node has the high level; and the charge pump element connected to the Q' node.

2. The organic light emitting diode display of claim 1, wherein an emission clock is supplied to the charge pump element, and wherein the Q' node is changed from a floating state to the high level by the emission clock and the charge pump element.

3. The organic light emitting diode display of claim 2, wherein the charge pump element is a charge pump capacitor or a charge pump thin film transistor.

4. The organic light emitting diode display of claim 1, wherein the emission unit generates the plurality of emission signals using an emission start voltage, an emission reset voltage, a plurality of emission clocks, and the plurality of gate signals, wherein the plurality of emission clocks includes first to fifth emission clocks, wherein the plurality of gate signals includes nth and (n−1)th gate signals, wherein the plurality of emission signals includes nth and (n−1)th emission signals, wherein the plurality of stages includes an nth stage, and wherein the nth stage includes ninth to twentieth transistors, a second capacitor, and the charge pump element.

5. The organic light emitting diode display of claim 4, wherein a gate, a drain, and a source of the ninth transistor are connected to the first emission clock, an emission high potential voltage, and a drain of the tenth transistor, respectively, wherein a gate, the drain, and a source of the tenth transistor are connected to the (n−1)th emission signal or the emission start voltage, the source of the ninth transistor, and the Q node, respectively, wherein a gate, a drain, and a source of the eleventh transistor are connected to the QB node, the Q node, and an emission low potential voltage, respectively, wherein a gate, a drain, and a source of the twelfth transistor are connected to the (n−1)th gate signal, the emission high potential voltage, and the QB node, respectively, wherein a gate, a drain, and a source of the thirteenth transistor are connected to the Q node, the emission high potential voltage, and a drain of the fourteenth transistor, respectively, wherein a gate, the drain, and a source of the fourteenth transistor are connected to the QB node, the source of the thirteenth transistor, and a drain of the fifteenth transistor, respectively, wherein a gate, the drain, and a source of the fifteenth transistor are connected to the QB node, the source of the fourteenth transistor, and the emission low potential voltage, respectively, wherein a gate, a drain, and a source of the sixteenth transistor are connected to the nth gate signal, the emission reset voltage, and the QB node, respectively, wherein a gate, a drain, and a source of the seventeenth transistor are connected to a node between the thirteenth and fourteenth transistors, the emission high potential voltage, and a node between the fourteenth and fifteenth transistors, respectively, wherein a gate, a drain, and a source of the eighteenth transistor are connected to the second emission clock, the QB node, and the emission low potential voltage, respectively, wherein a gate, a drain, and a source of the nineteenth transistor are connected to the Q' node, the emission high potential voltage, and the QB node, respectively, wherein a gate, a drain, and a source of the twentieth transistor are connected to the (n−1)th emission signal or the emission start voltage, the Q' node, and the emission low potential voltage, respectively, wherein the second capacitor is connected between the node between the thirteenth and fourteenth transistors and the Q node, wherein the charge pump element is connected between the first emission clock and the Q' node, and wherein the nth emission signal is output from the node between the thirteenth and fourteenth transistors.

6. The organic light emitting diode display of claim 1, wherein the emission unit generates the plurality of emission signals using an emission start voltage and a plurality of emission clocks, wherein the plurality of emission clocks includes first and second emission clocks, wherein the plurality of emission signals includes nth and (n−1)th emission signals, wherein the plurality of stages includes an nth stage, and wherein the nth stage includes ninth to eleventh transistors, thirteenth to fifteenth transistors, seventeenth to twentieth transistors, a second capacitor, and the charge pump element.

7. The organic light emitting diode display of claim 6, wherein a gate, a drain, and a source of the ninth transistor are connected to the first emission clock, an emission high potential voltage, and a drain of the tenth transistor, respectively, wherein a gate, the drain, and a source of the tenth transistor are connected to the (n−1)th emission signal or the emission start voltage, the source of the ninth transistor, and the Q node, respectively, wherein a gate, a drain, and a source of the eleventh transistor are connected to the QB node, the Q node, and an emission low potential voltage, respectively, wherein a gate, a drain, and a source of the thirteenth transistor are connected to the Q node, the emission high potential voltage, and a drain of the fourteenth transistor, respectively, wherein a gate, the drain, and a source of the fourteenth transistor are connected to the QB node, the source of the thirteenth transistor, and a drain of the fifteenth transistor, respectively, wherein a gate, the drain, and a source of the fifteenth transistor are connected to the QB node, the source of the fourteenth transistor, and the emission low potential voltage, respectively, wherein a gate, a drain, and a source of the seventeenth transistor are connected to a node between the thirteenth and fourteenth transistors, the emission high potential voltage, and a node between the fourteenth and fifteenth transistors, respectively, wherein a gate, a drain, and a source of the eighteenth transistor are connected to the second emission clock, the QB node, and the emission low potential voltage, respectively, wherein a gate, a drain, and a source of the nineteenth transistor are connected to the Q' node, the emission high potential voltage, and the QB node, respectively, wherein a gate, a drain, and a source of the twentieth transistor are connected to the (n−1)th emission signal or the emission start voltage, the Q' node, and the emission low potential voltage, respectively, wherein the second capacitor is connected between the node between the thirteenth and fourteenth transistors and the Q node, wherein the charge pump element is connected between the first emission clock and the Q' node, and wherein the nth emission signal is output from the node between the thirteenth and fourteenth transistors.

8. An organic light emitting diode display, comprising:

a display panel including a plurality of pixels each including a light emitting diode;

a data driver configured to supply a plurality of data signals to the plurality of pixels;

a gate driver including a gate unit configured to supply a plurality of gate signals to the plurality of pixels and an emission unit configured to supply a plurality of emission signals to the plurality of pixels using a charge pump element and control a length of an emission period of the light emitting diode; and a timing controller configured to supply image data and a data control signal to the data driver and supply a gate control signal to the gate driver, wherein the emission unit includes a plurality of emission stages that are cascade-connected to one another, wherein each emission stage includes:

a start controller configured to set an emission Q node to a gate-on voltage in a period in which an emission start voltage and a first emission clock are synchronized;

a pull-up transistor configured to output a voltage of an output terminal as the gate-on voltage in response to a voltage of the emission Q node;

a pull-down transistor configured to output the voltage of the output terminal as a gate-off voltage in response to a voltage of an emission QB node;

a first QB node control transistor configured to set the emission QB node to the gate-on voltage in response to a voltage of an emission Q' node; and the charge pump element configured to set the emission Q' node to the gate-on voltage in response to a second emission clock having a phase opposite to the first emission clock.

9. The organic light emitting diode display of claim 8, wherein the start controller includes a ninth transistor and a tenth transistor, wherein the ninth transistor includes a gate receiving the first emission clock, a first electrode connected to an input terminal of the gate-on voltage, and a second electrode connected to a first electrode of the tenth transistor, and wherein the tenth transistor includes a gate receiving the emission start voltage or an emission signal of a previous stage, the first electrode connected to the second electrode of the ninth transistor, and a second electrode connected to the emission Q node.

10. The organic light emitting diode display of claim 9, wherein each emission stage further includes a twentieth transistor including a gate receiving the emission start voltage or the emission signal of the previous stage, a first electrode connected to the emission Q' node, and a second electrode connected to an input terminal of the gate-off voltage.

11. The organic light emitting diode display of claim 10, wherein an nth emission stage generating an nth emission signal further includes a second QB node control transistor configured to set the emission QB node to the gate-on voltage in response to a (n+1)th gate signal, where n is a natural number.

12. The organic light emitting diode display of claim 11, wherein the second QB node control transistor includes a gate receiving the (n+1)th gate signal, a first electrode connected to an input terminal of the second emission clock, and a second electrode connected to the emission QB node.

13. The organic light emitting diode display of claim 12, wherein a driving period of an nth pixel on an nth pixel line in one frame includes an initial period, a sampling period, and an emission period that are controlled by an nth gate signal and an nth emission signal, wherein during the initial period, the nth gate signal and the nth emission signal applied to the nth pixel are held at the gate-on voltage, wherein during the sampling period, the nth gate signal applied to the nth pixel is held at the gate-on voltage, wherein the second emission clock is inverted to the gate-on voltage at a start time of the sampling period.

* * * * *